US011713497B2

(12) United States Patent
Tabata et al.

(10) Patent No.: US 11,713,497 B2
(45) Date of Patent: Aug. 1, 2023

(54) STEEL MEMBER AND METHOD OF MANUFACTURING SAME

(71) Applicant: NIPPON STEEL CORPORATION, Tokyo (JP)

(72) Inventors: Shinichiro Tabata, Tokyo (JP); Yoshihiro Suwa, Tokyo (JP); Kazuo Hikida, Tokyo (JP); Kazuhisa Kusumi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 275 days.

(21) Appl. No.: 17/049,493

(22) PCT Filed: Apr. 23, 2019

(86) PCT No.: PCT/JP2019/017177
§ 371 (c)(1),
(2) Date: Oct. 21, 2020

(87) PCT Pub. No.: WO2019/208556
PCT Pub. Date: Oct. 31, 2019

(65) Prior Publication Data

US 2021/0262073 A1 Aug. 26, 2021

(30) Foreign Application Priority Data

Apr. 23, 2018 (JP) ..... 2018-082625

(51) Int. Cl.
*C22C 38/02* (2006.01)
*C22C 38/58* (2006.01)
(Continued)

(52) U.S. Cl.
CPC ..... *C22C 38/58* (2013.01); *C21D 9/46* (2013.01); *C22C 38/002* (2013.01);
(Continued)

(58) Field of Classification Search
CPC ..... C21D 2211/008
See application file for complete search history.

(56) References Cited

U.S. PATENT DOCUMENTS

2009/0238713 A1* 9/2009 Kinugasa ..... C22C 38/14 420/104
2013/0048161 A1 2/2013 Matsuda et al.
(Continued)

FOREIGN PATENT DOCUMENTS

JP 2002-102980 A 4/2002
JP 2007-197819 A 8/2007
(Continued)

OTHER PUBLICATIONS

"Method for Charpy pendulum impact test of metallic materials", JIS Z 2242, 2005, total 12 pages.
(Continued)

*Primary Examiner* — Jophy S. Koshy
(74) *Attorney, Agent, or Firm* — Birch, Stewart, Kolasch & Birch, LLP

(57) ABSTRACT

A steel member according to an aspect of the present invention has a predetermined chemical composition, in which a metallographic structure includes, by a volume %, 60.0% to 85.0% of martensite, 10.0% to 30.0% of bainite, 5.0% to 15.0% of residual austenite, and 0% to 4.0% of a remainder in microstructure. A length of a maximum minor axis of the residual austenite is 30 nm or longer. A number density of a carbide which exist in the steel member and has a circle equivalent diameter of 0.1 μm or more and an aspect ratio of 2.5 or less is $4.0\times10^3$ pieces/mm$^2$ or less.

12 Claims, 1 Drawing Sheet

(51) Int. Cl.

| | |
|---|---|
| ***C21D 9/46*** | (2006.01) |
| ***C22C 38/00*** | (2006.01) |
| ***C22C 38/06*** | (2006.01) |
| ***C22C 38/12*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| *C21D 8/02* | (2006.01) |

(52) U.S. Cl.

CPC ..... *C22C 38/005* (2013.01); *C22C 38/008* (2013.01); *C22C 38/02* (2013.01); *C22C 38/06* (2013.01); *C22C 38/12* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 8/0205* (2013.01); *C21D 8/0226* (2013.01); *C21D 8/0236* (2013.01); *C21D 2211/001* (2013.01); *C21D 2211/002* (2013.01); *C21D 2211/008* (2013.01)

(56) References Cited

U.S. PATENT DOCUMENTS

| | | | |
|---|---|---|---|
| 2013/0295402 | A1 | 11/2013 | Oh et al. |
| 2014/0056754 | A1 | 2/2014 | Naitou et al. |
| 2018/0171429 | A1 | 6/2018 | Suwa et al. |
| 2019/0330721 | A1 | 10/2019 | Hayashi et al. |

FOREIGN PATENT DOCUMENTS

| | | | |
|---|---|---|---|
| JP | 2012-1802 | A | 1/2012 |
| JP | 2012-180594 | A | 9/2012 |
| WO | WO 2011/111333 | A1 | 9/2011 |
| WO | WO 2012/091328 | A2 | 7/2012 |
| WO | WO 2012/169638 | A1 | 12/2012 |
| WO | WO 2016/163468 | A1 | 10/2016 |
| WO | WO 2018/055695 | A1 | 3/2018 |

OTHER PUBLICATIONS

"Microscopic testing method for the non-metallic inclusions in steel", JIS G 0555, 2003, total 21 pages.

"Standard Methods of Tension Testing of Metallic Materials", American National Standard Z168.13-1791, ASTM E8-69, pp. 120-140, total 17 pages.

* cited by examiner

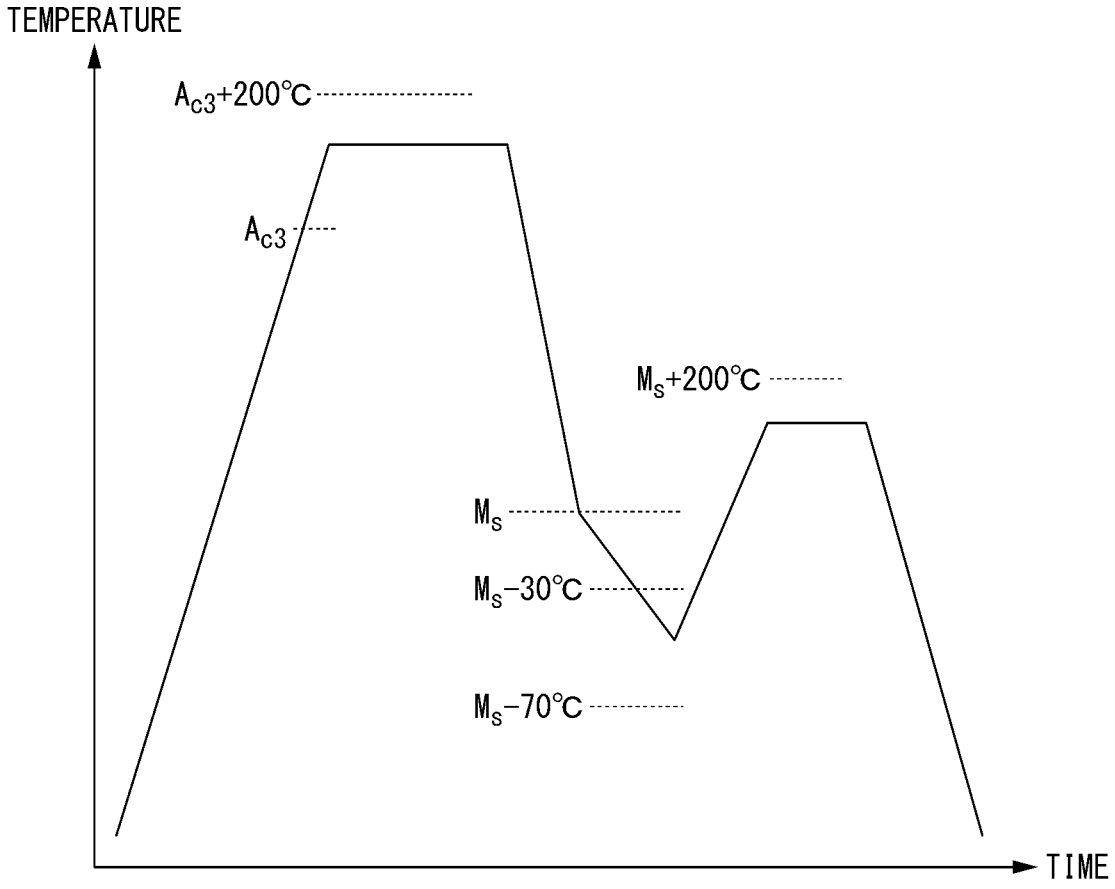
TEMPERATURE
$A_{c3}$+200℃
$A_{c3}$
$M_s$+200℃
$M_s$
$M_s$−30℃
$M_s$−70℃
TIME

STEEL MEMBER AND METHOD OF MANUFACTURING SAME

TECHNICAL FIELD OF THE INVENTION

The present invention relates to a steel member and a method of manufacturing the same.

Priority is claimed on Japanese Patent Application No. 2018-082625, filed Apr. 23, 2018, the content of which is incorporated herein by reference.

RELATED ART

In the field of a steel sheet for a vehicle, application of steel sheets having a high tensile strength is expanding in order to achieve both fuel efficiency and collision safety against the backdrop of recent stricter environmental regulations and collision safety standards. However, as the strength increases, press formability of a steel sheet decreases. Therefore, it becomes difficult to manufacture a product with a complicated shape. Specifically, due to a decrease in ductility of the steel sheet due to the increase in strength, breaking at highly worked portion is likely to occur. In addition, the residual stress after working may cause springback and warpage of the wall, which may reduce dimensional accuracy. Therefore, it is not easy to press-form a steel sheet having high strength, particularly a tensile strength of 780 MPa or more, into a product having a complicated shape. In a case of roll forming rather than press forming, high strength steel sheets are easily worked, but an application target thereof is limited to a part having a uniform cross section in a longitudinal direction.

In recent years, for example, as disclosed in Patent Documents 1 to 3, a hot stamping technique has been adopted as a technique for press-forming a material that is difficult to form, such as a high-strength steel sheet. The hot stamping technique is a hot forming technique in which a material used for forming is heated and then formed. In this technique, since the material is heated and then formed, a steel material is soft and has good formability during forming. Accordingly, even a high strength steel material can be formed into a complicated shape, with good accuracy. In addition, in the hot stamping technique, since hardening is performed simultaneously with forming using a press die, the steel material after forming has sufficient strength.

For example, according to Patent Document 1, it is possible to apply a tensile strength equal to or more than 1,400 MPa to the steel material after forming, by the hot stamping technique. In addition, Patent Document 2 discloses a press-formed article which is hot press-formed, is good in toughness, and has a tensile strength equal to or more than 1.8 GPa. In addition, Patent Document 3 discloses a steel material having a very high tensile strength equal to or more than 2.0 GPa and further having good toughness and ductility. In addition, Patent Document 4 discloses a steel material which has a tensile strength equal to or more than 1.4 GPa and is good in ductility. In addition, Patent Document 5 discloses a hot press-formed article good in ductility. In addition, Patent Document 6 discloses a press-formed member which has a tensile strength equal to or more than 980 MPa and is good in ductility. In addition, Patent Document 7 discloses a formed member which has a tensile strength equal to or more than 1,000 MPa and is good in ductility.

PRIOR ART DOCUMENT

Patent Document

[Patent Document 1] Japanese Unexamined Patent Application, First Publication No. 2002-102980
[Patent Document 2] Japanese Unexamined Patent Application, First Publication No. 2012-180594
[Patent Document 3] Japanese Unexamined Patent Application, First Publication No. 2012-1802
[Patent Document 4] PCT International Publication No. WO 2016/163468
[Patent Document 5] PCT International Publication No. WO 2012/169638
[Patent Document 6] PCT International Publication No. WO 2011/111333
[Patent Document 7] PCT International Publication No. WO 2012/091328

DISCLOSURE OF THE INVENTION

Problems to be Solved by the Invention

A steel sheet for a vehicle applied to a vehicle body is required to have not only above-described formability but also collision safety after forming. The collision safety of a vehicle is evaluated by crushing strength and absorbed energy in a crash test of the entire vehicle body or a steel member. In particular, since the crushing strength greatly depends on material strength, the demand for ultra-high strength steel sheets is dramatically increasing. However, generally in a vehicle member, as the strength of a steel sheet material increases, fracture toughness and deformability decreases. Therefore, the vehicle member breaks prematurely when the vehicle member collides and is crushed or breaking at a portion where deformation is concentrated occurs. The crushing strength commensurate with the material strength is not exhibited, and the absorbed energy decreases. Therefore, in order to improve the collision safety, it is important to improve not only the material strength but also the fracture toughness and deformability of the vehicle member, that is, to improve the toughness and ductility of the steel sheet material.

In the techniques described in Patent Documents 1 and 2, although a tensile strength and toughness are described, ductility is not taken into consideration. In addition, according to the techniques described in Patent Documents 3 and 4, it is possible to improve a tensile strength, toughness, and ductility. However, in the methods described in Patent Documents 3 and 4, exclusion of a fracture origin or control of a highly ductile structure is not sufficient, and it may not be possible to further improve toughness and ductility. In addition, in the techniques of Patent Documents 5, 6, and 7, although tensile properties and ductility are described, toughness is not taken into consideration.

The present invention has been made to solve the above problems, and an object of the present invention is to provide a steel member which has a high tensile strength and is good in ductility and a method of manufacturing the same. More preferably, another object of the present invention is to provide a steel member which has the various properties described above and is good in toughness, and a method of manufacturing the same.

Means for Solving the Problem

The gist of the present invention is a steel member and a method of manufacturing the same described below.

In many cases, a hot-formed steel member is a formed body rather than a flat sheet. In the present invention, a case of the formed body is also referred to as a "steel member". In addition, a steel sheet that is a material before heat treatment of the steel member is referred to as a "base steel sheet".

[1] The steel member according to an aspect of the present invention includes, as a chemical composition, by mass %:

C: 0.10% to 0.60%;
Si: 0.40% to 3.00%;
Mn: 0.30% to 3.00%;
P: 0.050% or less;
S: 0.0500% or less;
N: 0.010% or less;
Ti: 0.0010% to 0.1000%;
B: 0.0005% to 0.0100%;
Cr: 0% to 1.00%;
Ni: 0% to 2.0%;
Cu: 0% to 1.0%;
Mo: 0% to 1.0%;
V: 0% to 1.0%;
Ca: 0% to 0.010%;
Al: 0% to 1.00%;
Nb: 0% to 0.100%;
Sn: 0% to 1.00%;
W: 0% to 1.00%;
REM: 0% to 0.30%; and
a remainder consisting of Fe and impurities, in which a metallographic structure includes, by a volume fraction, 60.0% to 85.0% of martensite, 10.0% to 30.0% of bainite, 5.0% to 15.0% of residual austenite, and 0% to 4.0% of a remainder in microstructure, a length of a maximum minor axis of the residual austenite is 30 nm or longer, and a number density of a carbide having a circle equivalent diameter of 0.1 μm or more and an aspect ratio of 2.5 or less is $4.0\times10^3$ pieces/mm$^2$ or less.

[2] The steel member according to [1] may include, as the chemical composition, by mass %, at least one selected from the group consisting of:

Cr: 0.01% to 1.00%;
Ni: 0.01% to 2.0%;
Cu: 0.01% to 1.0%;
Mo: 0.01% to 1.0%;
V: 0.01% to 1.0%;
Ca: 0.001% to 0.010%;
Al: 0.01% to 1.00%;
Nb: 0.010% to 0.100%;
Sn: 0.01% to 1.00%;
W: 0.01% to 1.00%; and
REM: 0.001% to 0.30%.

[3] In the steel member according to [1] or [2], a value of a strain-induced transformation parameter k represented by Expression (1) below may be less than 18.0.

$$k=(\log f_{\gamma 0}-\log f_{\gamma}(0.02))/0.02 \quad \text{Expression (1)}$$

Here, meaning of each symbol in Expression (1) above is as follows:

$f_{\gamma}0$: Volume fraction of residual austenite present in the steel member before true strain is applied $f_{\gamma}(0.02)$: Volume fraction of residual austenite present in the steel member after 0.02 of true strain is applied to the steel member and then unloaded

[4] In the steel member according to any one of [1] to [3], a tensile strength may be 1,400 MPa or more, and a total elongation may be 10.0% or higher.

[5] In the steel member according to any one of [1] to [4], a local elongation may be 3.0% or higher.

[6] In the steel member according to any one of [1] to [5], an impact value at −80° C. is 25.0 J/cm$^2$ or more.

[7] In the steel member according to any one of [1] to [6], a value of cleanliness of a steel specified by JIS G 0555: 2003 is 0.100% or less.

[8] A method of manufacturing a steel member according to another aspect of the present invention is a method of manufacturing the steel member according to any one of [1] to [7], the method including:

a heating process of heating a base steel sheet to a temperature range of $Ac_3$ point to ($Ac_3$ point+200)° C. at an average heating rate of 5 to 300° C./s, the base steel sheet including, as a chemical composition, by mass %, C: 0.10% to 0.60%, Si: 0.40% to 3.00%, Mn: 0.30% to 3.00%, P: 0.050% or less, S: 0.0500% or less, N: 0.010% or less, Ti: 0.0010% to 0.1000%, B: 0.0005% to 0.0100%, Cr: 0% to 1.00%, Ni: 0% to 2.0%, Cu: 0% to 1.0%, Mo: 0% to 1.0%, V: 0% to 1.0%, Ca: 0% to 0.010%, Al: 0% to 1.00%, Nb: 0% to 0.100%, Sn: 0% to 1.00%, W: 0% to 1.00%, REM: 0% to 0.30%, and a remainder consisting of Fe and impurities, in which a number density of carbide having a circle equivalent diameter of 0.1 μm or more and an aspect ratio of 2.5 or less is $8.0\times10^3$ pieces/mm$^2$ or less, and an average value of circle equivalent diameters of (Nb,Ti)C is 5.0 or less;

a first cooling process of cooling the base steel sheet to a Ms point at a first average cooling rate equal to or higher than an upper critical cooling rate, after the heating process;

a second cooling process of cooling the base steel sheet to a temperature range of (Ms-30)° C. to (Ms-70)° C. at a second average cooling rate of 5° C./s or higher and lower than 150° C./s, which is slower than the first average cooling rate, after the first cooling process;

a reheating process of reheating the base steel sheet to a temperature range of Ms to (Ms+200)° C. at an average heating rate of 5° C./s or higher, after the second cooling process; and a third cooling process of cooling the base steel sheet at a third average cooling rate of 5° C./s or higher, after the reheating process.

[9] The method of manufacturing a steel member according to [8] may further include a holding process of holding the base steel sheet at the temperature range of $Ac_3$ point to ($Ac_3$ point+200)° C. for 5 to 200 seconds, between the heating process and the first cooling process.

[10] The method of manufacturing a steel member according to [8] or [9] may further include a holding process of holding the base steel sheet at the temperature range of Ms to (Ms+200)° C. for 3 to 60 seconds, between the reheating process and the third cooling process.

[11] The method of manufacturing a steel member according to any one of [8] to [10] may further include hot forming the base steel sheet, between the heating process and the first cooling process.

[12] In the method of manufacturing a steel member according to any one of [8] to [10], in the first cooling process, the base steel sheet may be cooled at the first cooling rate and hot-formed at the same time.

Effects of the Invention

According to the aspect of the present invention, it is possible to provide a steel member which has a high tensile strength and is good in ductility and a method of manufacturing the same. According to a preferable aspect of the present invention, it is possible to provide a steel member which has the various properties described above and is good in toughness, and a method of manufacturing the same.

BRIEF DESCRIPTION OF THE DRAWINGS

FIG. 1 is a graph showing a temperature history of each process in a method of manufacturing a steel member according to the present embodiment.

EMBODIMENTS OF THE INVENTION

Hereinafter, a steel member according to an embodiment of the present invention and a method of manufacturing the same will be described in detail. However, the present invention is not limited to the configuration disclosed in the present embodiment, and various modifications can be made without departing from the gist of the present invention.

(A) Chemical Composition of Steel Member

The reasons for limiting each element of the steel member according to the present embodiment are as follows. In addition, in the following description, "%" regarding the content means "mass %". In numerical limit ranges to be described below, the range includes a lower limit and an upper limit. In numerical values shown as "more than" or "less than", the values do not fall within the numerical range. All "%" regarding the chemical composition represent mass %.

C: 0.10% to 0.60%

C is an element that enhances hardenability of a steel and improves strength of the steel member after hardening. However, when a C content is less than 0.10%, it becomes difficult to secure sufficient strength in the steel member after hardening. Therefore, the C content is set to 0.10% or more. The C content is preferably 0.15% or more, or 0.20% or more. On the other hand, when the C content is more than 0.60%, the strength of the steel member after hardening becomes too high and the toughness deteriorates significantly. Therefore, the C content is set to 0.60% or less. The C content is preferably 0.50% or less, or 0.45% or less.

Si: 0.40% to 3.00%

Si is an element that enhances the hardenability of the steel and improves the strength of the steel member by solid solution strengthening. Further, since Si hardly forms a solid solution in a carbide, Si suppresses precipitation of the carbide during hot forming and promotes C concentration to untransformed austenite. As a result, a Ms point is significantly lowered, and a large amount of solid solution strengthened austenite can be remained. In order to obtain this effect, it is necessary to contain 0.40% or more of Si. When a Si content is 0.40% or more, a residual carbide tends to decrease. As will be described later, when there are many carbides that precipitate in a base steel sheet before heat treatment, the carbides remain unmelted during the heat treatment, sufficient hardenability cannot be secured, low-strength ferrite precipitates, and strength of the steel member may be insufficient. Therefore, also in this sense, the Si content is set to 0.40% or more. The Si content is preferably 0.50% or more, or 0.60% or more.

However, when the Si content in the steel is more than 3.00%, a heating temperature required for austenite transformation increases significantly during heat treatment. Accordingly, costs required for the heat treatment may increase, and ferrite may remain without being sufficiently austenitized and a desired metallographic structure and strength may not be obtained. Therefore, the Si content is set to 3.00% or less. The Si content is preferably 2.50% or less, or 2.00% or less.

Mn: 0.30% to 3.00%

Mn is an extremely effective element for enhancing the hardenability of the base steel sheet and stably securing the strength after hardening. Furthermore, Mn is an element that lowers an $Ac_3$ point and promotes lowering of hardening temperature. However, when a Mn content is less than 0.30%, the above effect are not sufficiently obtained. Therefore, the Mn content is set to 0.30% or more. The Mn content is preferably 0.40% or more. On the other hand, when the Mn content is more than 3.00%, the above effect is saturated and further the toughness of the hardened portion deteriorates. Therefore, the Mn content is set to 3.00% or less. The Mn content is preferably 2.80% or less, and more preferably 2.50% or less.

P: 0.050% or less

P is an element that deteriorates the toughness of the steel member after hardening. In particular, when a P content is more than 0.050%, the toughness of the steel member deteriorates significantly. Therefore, the P content is limited to 0.050% or less. The P content is preferably limited to 0.030% or less, 0.020% or less, or 0.005% or less. Although P is mixed as an impurity, it is not necessary to particularly limit a lower limit thereof, and it is preferable that the P content is low, in order to obtain the toughness of the steel member. However, when the P content is excessively reduced, manufacturing costs increase. From a viewpoint of the manufacturing costs, the P content may be 0.001% or more.

S: 0.0500% or less

S is an element that deteriorates the toughness of the steel member after hardening. In particular, when a S content is more than 0.0500%, the toughness of the steel member deteriorates significantly. Therefore, the S content is limited to 0.0500% or less. The S content is preferably limited to 0.0030% or less, 0.0020% or less, or 0.0015% or less. Although S is mixed as an impurity, it is not necessary to particularly limit a lower limit thereof, and it is preferable that the S content is low, in order to obtain the toughness of the steel member. However, when the S content is excessively reduced, manufacturing costs increase. From a viewpoint of the manufacturing costs, the S content may be 0.0001% or more.

N: 0.010% or less

N is an element that deteriorates the toughness of the steel member after hardening. In particular, when a N content is more than 0.010%, coarse nitrides are formed in the steel, and local deformability and the toughness of the steel member deteriorate significantly. Therefore, the N content is set to 0.010% or less. A lower limit of the N content does not need to be particularly limited, but when the N content is set to less than 0.0002%, steel manufacturing costs increase, which is not preferable economically. Therefore, the N content is preferably 0.0002% or more, and more preferably 0.0008% or more.

Ti: 0.0010% to 0.1000%

Ti is an element that suppresses recrystallization when performing heat treatment by heating the base steel sheet to a temperature of $Ac_3$ point or higher, and forms fine carbides to suppress grain growth, thereby having an action of making austenite grains fine. Therefore, when containing Ti, an effect of significantly improving the toughness of the steel member is obtained. In addition, Ti suppresses consumption of B due to precipitation of BN by preferentially bonding with N in the steel, and promotes an effect of improving the hardenability by B to be described later. When a Ti content is less than 0.0010%, the above effect is not sufficiently obtained. Therefore, the Ti content is set to 0.0010% or more. The Ti content is preferably 0.0100% or more, or 0.0200% or more. On the other hand, when the Ti content is more than 0.1000%, since the precipitation amount of TiC increases and C is consumed, the strength of the steel member after hardening decreases. Therefore, the Ti content is set to 0.1000% or less. The Ti content is preferably 0.0800% or less, or 0.0600% or less.

B: 0.0005% to 0.0100%

B has an action of dramatically enhancing the hardenability of the steel even in a small amount, and thus, is a very important element in the present embodiment. In addition, B segregates at a grain boundary to strengthen the grain boundary and enhance the toughness of the steel member. Furthermore, B suppresses grain growth of austenite during heating of the base steel sheet. When a B content is less than 0.0005%, the above effects may not be sufficiently obtained. Therefore, the B content is set to 0.0005% or more. The B content is preferably 0.0010% or more, 0.0015% or more, or 0.0020% or more. On the other hand, when the B content is more than 0.0100%, a large amount of coarse compounds precipitate, and the toughness of the steel member deteriorates. Therefore, the B content is set to 0.0100% or less. The B content is preferably 0.0080% or less, or 0.0060% or less.

In the chemical composition of the steel member according to the present embodiment, a component other than elements described above, that is, the remainder is Fe and impurities. Here, the "impurities" are components that are mixed by raw materials such as ores and scrap, and various factors in a manufacturing process when the steel sheet is industrially manufactured, and mean those allowed within a range that does not adversely affect the steel member according to the present embodiment.

In the steel member according to the present embodiment, one or more optional elements selected from Cr, Ni, Cu, Mo, V, Ca, Al, Nb, Sn, W, and REM to be shown below may be contained in place of part of Fe in the remainder. However, since the steel member according to the present embodiment can solve the problem without containing the optional element to be shown below, a lower limit of a content in a case of not containing the optional element is 0%.

Cr: 0% to 1.00%

Cr is an element that enhances the hardenability of the steel and enables the strength of the steel member after hardening to be stably secured. Therefore, Cr may be contained. In order to reliably obtain the effect, a Cr content is preferably 0.01% or more, and more preferably 0.05% or more. However, when the Cr content is more than 1.00%, the above effect is saturated, and the costs increase unnecessarily. In addition, since Cr has an action of stabilizing an iron carbide, when the Cr content is more than 1.00%, coarse iron carbide remains unmelted during heating of the base steel sheet, and the toughness of the steel member deteriorates. Therefore, the Cr content in a case of containing Cr is set to 1.00% or less. The Cr content is preferably 0.80% or less.

Ni: 0% to 2.0%

Ni is an element that enhances the hardenability of the steel and enables the strength of the steel member after hardening to be stably secured. Therefore, Ni may be contained. In order to reliably obtain the effect, a Ni content is preferably 0.01% or more, and more preferably 0.1% or more. However, when the Ni content is more than 2.0%, the above effect is saturated and the costs increase. Therefore, the Ni content in a case of containing Ni is set to 2.0% or less.

Cu: 0% to 1.0%

Cu is an element that enhances the hardenability of the steel and enables the strength of the steel member after hardening to be stably secured. Therefore, Cu may be contained. In addition, Cu improves corrosion resistance of the steel member in a corrosive environment. In order to reliably obtain the effect, a Cu content is preferably 0.01%, and more preferably 0.1% or more. However, when the Cu content is more than 1.0%, the above effect is saturated and the costs increase. Therefore, the Cu content in a case of containing Cu is set to 1.0% or less.

Mo: 0% to 1.0%

Mo is an element that enhances the hardenability of the steel and enables the strength of the steel member after hardening to be stably secured. Therefore, Mo may be contained. In order to reliably obtain the effect, a Mo content is preferably 0.01% or more, and more preferably 0.1% or more. However, when the Mo content is more than 1.0%, the above effect is saturated and the costs increase. In addition, since Mo has an action of stabilizing an iron carbide, when the Mo content is more than 1.00%, coarse iron carbide remains unmelted during heating of the base steel sheet, and the toughness of the steel member deteriorates. Therefore, the Mo content in a case of containing Mo is set to 1.0% or less.

V: 0% to 1.0%

V is an element that forms fine carbides and enhances the toughness of the steel member due to the fine-granulating effect. Therefore, V may be contained. In order to reliably obtain the effect, a V content is preferably 0.01% or more, and more preferably 0.1% or more. However, when the V content is more than 1.0%, the above effect is saturated and the costs increase. Therefore, the V content in a case of containing V is set to 1.0% or less.

Ca: 0% to 0.010%

Ca is an element that has effects of refining grains of inclusions in the steel and improving the toughness and ductility of the steel member after hardening. Therefore, Ca may be contained. In a case of reliably obtaining the effect, a Ca content is preferably 0.001% or more, and more preferably 0.002% or more. However, when the Ca content is more than 0.010%, the above effect is saturated, and the costs increase unnecessarily. Therefore, the Ca content in a case of containing Ca is set to 0.010% or less. The Ca content is preferably 0.005% or less, and more preferably 0.004% or less.

Al: 0% to 1.00%

Al is generally used as a deoxidizing agent for steel. Therefore, Al may be contained. In order to sufficiently deoxidize the steel with Al, an Al content is preferably 0.01% or more. However, when the Al content is more than 1.00%, the above effect is saturated and the costs increase. Therefore, the Al content in a case of containing Al is set to 1.00% or less.

Nb: 0% to 0.100%

Nb is an element that forms fine carbides and enhances the toughness of the steel member due to the grain refining effect. Therefore, Nb may be contained. In order to reliably obtain the effect, a Nb content is preferably 0.010% or more. However, when the Nb content is more than 0.100%, the above effect is saturated and the costs increase. Therefore, the Nb content in a case of containing Nb is set to 0.100% or less.

Sn: 0% to 1.00%

Sn improves the corrosion resistance of the steel member in a corrosive environment. Therefore, Sn may be contained. In order to reliably obtain the effect, a Sn content is preferably 0.01% or more. However, when the Sn content is more than 1.00%, grain boundary strength decreases and the toughness of the steel member deteriorates. Therefore, the Sn content in a case of containing Sn is set to 1.00% or less.

W: 0% to 1.00%

W is an element that enhances the hardenability of the steel and enables the strength of the steel member after hardening to be stably secured. Therefore, W may be contained. In addition, W improves corrosion resistance of the steel member in a corrosive environment. In order to reliably obtain these effects, a W content is preferably 0.01% or more. However, when the W content is more than 1.00%, the above effect is saturated and the costs increase. Therefore, the W content in a case of containing W is set to 1.00% or less.

REM: 0% to 0.30%

REM is an element that has effects of refining grains of inclusions in the steel and improving the toughness and ductility of the steel member after hardening, similar to Ca. Therefore, REM may be contained. In order to reliably obtain the effect, a REM content is preferably 0.001% or more, and more preferably 0.002% or more. However, when the REM content is more than 0.30%, the effect is saturated, and the costs increase unnecessarily. Therefore, the REM content in a case of containing REM is set to 0.30% or less. The REM content is preferably 0.20% or less.

Here, REM indicates a total of 17 elements consisting of Sc, Y and lanthanoids such as La and Nd, and the REM content means a total content of these elements. REM is added to a molten steel using, for example, an Fe—Si-REM alloy, and the alloy includes, for example, Ce, La, Nd, and Pr.

(B) Metallographic Structure of Steel Member

The steel member according to the present embodiment has a metallographic structure including, by a volume fraction, 60.0% to 85.0% of martensite, 10.0% to 30.0% of bainite, 5.0% to 15.0% of residual austenite, and 0% to 4.0% of a remainder in microstructure.

In addition, a length of a maximum minor axis of the residual austenite is 30 nm or longer.

The martensite present in the steel member according to the present embodiment also includes auto-tempered martensite. The auto-tempered martensite is a tempered martensite generated in cooling during hardening without performing heat treatment for tempering and is generated by tempering of the generated martensite due to the heat generated by martensitic transformation. The tempered martensite can be distinguished from hardened martensite depending on the presence or absence of fine cementite precipitated inside a lath.

Martensite: 60.0% to 85.0%

Martensite is a hard phase and is a structure necessary for increasing the strength of the steel member. When the volume fraction of the martensite is less than 60.0%, the tensile strength of the steel member cannot be sufficiently secured. Therefore, the volume fraction of the martensite is set to 60.0% or more. The volume fraction of the martensite is preferably 65.0% or more. On the other hand, when the volume fraction of the martensite is more than 85.0%, other structures such as bainite and residual austenite to be described later cannot be sufficiently secured. Therefore, the volume fraction of the martensite is set to 85.0% or less. The volume fraction of the martensite is preferably 80.0% or less.

Bainite: 10.0% to 30.0%

Bainite is a structure having hardness which is higher than that of the residual austenite and lower than that of the martensite. When the bainite is present, the hardness gap between the residual austenite and the martensite is alleviated, a crack at a boundary between the residual austenite and the martensite is prevented from being initiated during application of stress, and the toughness and the ductility of the steel member is improved. When the volume fraction of the bainite is less than 10.0%, the above effect is not obtained. Therefore, the volume fraction of the bainite is set to 10.0% or more. The preferable volume fraction of the bainite is 15.0% or more. In addition, when the volume fraction of the bainite is more than 30.0%, the strength of the steel member decreases. Therefore, the volume fraction of the bainite is set to 30.0% or less. The preferable volume fraction of the bainite is 25.0% or less, and more preferably 20.0% or less.

Residual austenite: 5.0% to 15.0%

The residual austenite has an effect (TRIP effect) of preventing necking, promoting work hardening, and improving the ductility by undergoing martensitic transformation (work-induced transformation) during plastic deformation. Further, the residual austenite has an effect of relaxing stress concentration at a crack tip, and improving not only the ductility but also the toughness of the steel member, by transformation of the residual austenite. In particular, when the volume fraction of the residual austenite is less than 5.0%, the ductility of the steel member is significantly reduced, risk of breaking in the steel member increases, and the collision safety is reduced. Therefore, the volume fraction of the residual austenite is set to 5.0% or more. The volume fraction is preferably 6.0% or more, and more preferably 7.0% or more. On the other hand, when the volume fraction of the residual austenite is excessive, the strength may decrease. Therefore, the volume fraction of the residual austenite is set to 15.0% or less. Preferably, the volume fraction of the residual austenite is 12.0% or less, or 10.0% or less.

The residual austenite present in the steel member according to the present embodiment exists between the laths of the martensite, between bainitic ferrites of the bainite, or at a prior austenite grain boundary (prior γ grain boundary). The residual austenite is preferably present between the laths of the martensite or between the bainitic ferrites of the bainite. The residual austenite present at these positions is flat, and thus has an effect of promoting the deformation near these positions and improving the ductility and the toughness of the steel member.

Remainder in Microstructure: 0% to 4.0%

Ferrite and pearlite may be present by being mixed as the remainder in microstructure in the steel member according to the present embodiment. In the present embodiment, the total volume fraction of the martensite, the bainite, and the residual austenite needs to be 96.0% or more. That is, in the present embodiment, the remainder in microstructure other than the martensite, the bainite, and the residual austenite is limited to 4.0% or less, by a volume fraction. Since the remainder in microstructure may be 0%, the volume fraction of the remainder in microstructure is set to 0% to 4.0%.

Maximum Minor Axis of Residual Austenite: 30 nm or Longer

In the present embodiment, the maximum minor axis of the residual austenite is set to 30 nm or longer. The residual austenite having the maximum minor axis of shorter than 30 nm is not stable in deformation, that is, undergoes martensitic transformation in a low strain region at an early stage of plastic deformation. Therefore, this residual austenite cannot sufficiently contribute to improvement of ductility and collision safety of the steel member. Therefore, the maximum minor axis of the residual austenite is set to 30 nm or longer. An upper limit of the maximum minor axis of the residual austenite is not particularly limited. When the residual austenite is excessively stable in deformation, the TRIP effect will not be sufficiently exhibited. Therefore, the upper limit thereof may be 600 nm or shorter, 100 nm or shorter, or 60 nm or shorter.

Methods of measuring the volume fraction of the martensite, the bainite, and the residual austenite, the position where the residual austenite is present, and the maximum minor axis of the residual austenite will be described.

The volume fraction of the residual austenite is measured using an X-ray diffraction method. First, a test piece is taken from a position 100 mm away from the end portion of the steel member. In a case where the test piece cannot be taken from the position 100 mm away from the end, due to a shape of the steel member, the test piece may be taken from a soaking portion avoiding the end. This is because the end portion of the steel member is not sufficiently heat-treated and may not have the metallographic structure of the steel member according to the present embodiment.

The test piece is chemical-polished from the surface to a depth of ¼ in the sheet thickness, using hydrofluoric acid and hydrogen peroxide solution. As measurement conditions, a Co tube is used and a range of 45° to 105° at 2θ is set. The diffracted X-ray intensity of a face centered cubic lattice (residual austenite) contained in the steel member is measured, and the volume fraction of the residual austenite is calculated from an area ratio of the diffraction curve. Accordingly, the volume fraction of the residual austenite is obtained. According to the X-ray diffraction method, the volume fraction of the residual austenite in the steel member can be measured with high accuracy.

The volume fraction of the martensite and the volume fraction of the bainite are measured by a transmission electron microscope (TEM) and an electron beam diffractometer attached to the TEM. A measurement sample is cut out from the position 100 mm away from the end portion of the steel member and at ¼ depth in the sheet thickness to obtain a thin film sample for TEM observation. In a case where the measurement sample cannot be taken from the position 100 mm away from the end, due to a shape of the steel member, the measurement sample may be taken from a soaking portion avoiding the end. In addition, a range of the TEM observation is 50 $\mu m^2$ or larger in area, and magnification is 10,000 to 50,000. An iron carbide ($Fe_3C$) in the martensite and the bainite is found by a diffraction pattern and a precipitation form is observed to determine the martensite and the bainite. An area fraction of the martensite and an area fraction of the bainite are measured. When the precipitation form of the iron carbide is three-way precipitation, it is determined as the martensite, and when the precipitation form is one-way limited precipitation, it is determined as the bainite. The fraction of the martensite and the bainite, measured by the TEM is measured as an area fraction. However, since the steel member according to the present embodiment has an isotropic metallographic structure, a value of the area fraction can be directly replaced by volume fraction. Although the iron carbide is observed to determine between the martensite and the bainite, the iron carbide is not contained in the volume fraction of the metallographic structure in the present embodiment.

Whether or not the ferrite or the pearlite is present as the remainder in microstructure is confirmed by an optical microscope or a scanning electron microscope. In a case where the ferrite or the pearlite is present, the area fraction thereof is obtained, and the value is directly converted into the volume fraction to obtain the volume fraction of the remainder in microstructure. However, in the steel member according to the present embodiment, the remainder in microstructure is often not observed in many cases.

For the volume fraction of the remainder in microstructure, a measurement sample is cut out from a cross section at a position 100 mm away from the end portion of the steel member to obtain a measurement sample for observing the remainder in microstructure. In a case where the measurement sample cannot be taken from the position 100 mm away from the end, due to a shape of the steel member, the measurement sample may be taken from the soaking portion avoiding the end. In addition, the observation range by the optical microscope or the scanning electron microscope is 40,000 $\mu m^2$ or larger in area, the magnification is 500 to 1,000, and an observation position is a ¼ position of the sheet thickness. The cut measurement sample is mechanically polished and then mirror-finished. Next, etching is performed with a nital etching solution (liquid mixture of nitric acid and ethyl or methyl alcohol) to expose ferrite and pearlite, and the presence of the ferrite or the pearlite is confirmed by observing the ferrite and the pearlite with a microscope. A structure in which the ferrites and the cementites are alternately arranged in layers is determined as pearlite, and a structure in which the cementite is precipitated in a granular form is determined as the bainite. The total of the observed area fractions of the ferrite and the pearlite is obtained, and the value is directly converted into the volume fraction to obtain the volume fraction of the remainder in microstructure.

In the present embodiment, since the volume fractions of the martensite and the bainite, the volume fraction of the residual austenite, and the volume fraction of the remainder in microstructure are measured by different measuring methods, the total of the above three volume fractions may not reach 100.0%. In a case where the total of the three volume fractions does not reach 100.0%, the three volume fractions may be adjusted so as to reach 100.0% in total. For example, in a case where the total of the volume fractions of the martensite and the bainite, the volume fraction of the residual austenite, and the volume fraction of the remainder in microstructure is 101.0%, in order to make the total 100.0%, a value obtained by multiplying the volume fraction of each structure obtained by the measurement by 100.0/101.0 may be taken as the volume fraction of each structure.

In a case where the total of the volume fractions of the martensite and the bainite, the volume fraction of the residual austenite, and the volume fraction of the remainder in microstructure is less than 95.0% or more than 105.0%, the volume fraction is measured again.

The position where the residual austenite is present is confirmed using the TEM.

In the martensite in the metallographic structure of the steel member according to the present embodiment, there are a plurality of packets in the prior austenite grains. There is a block that is a parallel strip-shaped structure inside each packet. Further, There is a set of laths, which are crystals of the martensite with almost the same crystal orientation, in each block. In a case where the laths are confirmed by the TEM, the selected area diffraction pattern is measured near the boundary between the laths to confirm the electron beam diffraction pattern near the boundary between the laths, and the electron beam diffraction pattern of the face centered cubic lattice is detected, it is determined that there is the residual austenite between the laths. Since the lath is a body centered cubic lattice and the residual austenite is a face centered cubic lattice, it can be easily determined by electron beam diffraction.

In addition, the bainite in the metallographic structure of the steel member according to the present embodiment is present in a state in which a plurality of bainitic ferrite crystal grains are aggregated. In a case where the crystal grains of the bainitic ferrite are confirmed by the TEM, the selected area diffraction pattern is measured near the grain boundary of the bainitic ferrite crystal grain to confirm the electron beam diffraction pattern near the grain boundary of the bainitic ferrite crystal grain, and an electron beam diffraction pattern of face centered cubic lattice is detected, it is determined that the residual austenite is present between the bainitic. Since the bainitic ferrite is a body centered cubic lattice and the residual austenite is a face centered cubic lattice, it can be easily determined by electron beam diffraction.

Furthermore, a prior austenite grain boundary is present in the metallographic structure of the steel member according to the present embodiment. In a case where the selected area diffraction pattern is measured near the prior austenite grain boundary to confirm the electron beam diffraction pattern near the prior austenite grain boundary, and the electron beam diffraction pattern of the face centered cubic lattice is detected, it is determined that the residual austenite is present at the prior austenite grain boundary. Since the martensite or the bainite of the body centered cubic lattice is present near the prior austenite grain boundary, the residual austenite of the face centered cubic lattice can be easily determined by electron beam diffraction.

The maximum minor axis of residual austenite is measured by the following method.

First, a thin film sample is taken from the position 100 mm away from the end portion of the steel member (in a case where the test piece cannot be taken from the position, a soaking portion avoiding the end) and at ¼ depth in the sheet thickness. This thin film sample is magnified 50,000 times with a transmission electron microscope, and 10 visual fields are randomly observed (one visual field is 1.0 μm×0.8 μm), and the residual austenite is identified using an electron beam diffraction pattern. In the residual austenite identified in each visual field, the minor axis of the "maximum residual austenite" is measured, three "minor axes" from the largest in 10 visual fields are selected, and an average value thereof is calculated to obtain the "maximum minor axis of residual austenite". Here, the "maximum residual austenite" is defined as residual austenite showing the maximum circle equivalent diameter, when the cross sectional area of the residual austenite crystal grains identified in each visual field is measured to obtain the circle equivalent diameter of a circle having the cross sectional area. In addition, the "minor axis" of the residual austenite is defined as a shortest distance (minimum Feret diameter) between parallel lines, in a case where, assuming two parallel lines sandwiching the crystal grains in contact with contours of the crystal grains with respect to the crystal grains of the residual austenite identified in each visual field, the parallel lines are drawn so as to have the shortest range between the parallel lines.

(C) Carbide

Carbides having a circle equivalent diameter of 0.1 μm or more and an aspect ratio of 2.5 or less: $4.0\times10^3$ pieces/mm$^2$ or less In a case of heat-treating the base steel sheet, sufficient hardenability can be secured by re-dissolving the carbides that are generally present in the base steel sheet. However, in a case where coarse carbides are present in the base steel sheet and the carbides are not sufficiently re-dissolved, sufficient hardenability cannot be secured, and low-strength ferrite precipitates. Therefore, as the amount of coarse carbides in the base steel sheet is smaller, the hardenability is improved and the steel member after heat treatment can have high strength.

When a large amount of coarse carbides are present in the base steel sheet, not only hardenability deteriorates, but also a large amount of a carbide remains in the steel member (residual carbides). Since many residual carbides are deposited on the prior γ grain boundary, the residual carbides embrittle the prior γ grain boundary. Further, when the amount of the residual carbides is excessive, since the residual carbides serve as void origins during deformation and facilitate connection, the ductility, particularly the local elongation, of the steel member decreases, resulting in deterioration of collision safety.

In particular, when the number density of the carbides having a circle equivalent diameter of 0.1 μm or more in the steel member is higher than $4.0\times10^3$ pieces/mm$^2$, the toughness and the ductility of the steel member deteriorate. Therefore, the number density of the carbides which are present in the steel member and have a circle equivalent diameter of 0.1 μm or more is set to $4.0\times10^3$ pieces/mm$^2$ or lower. Preferably, the number density is $3.5\times10^3$ pieces/mm$^2$ or lower.

Even in the base steel sheet before heat treatment, it is preferable that the amount of coarse carbide is small. In the present embodiment, it is preferable that the number density of the carbides which are present in the base steel sheet and have a circle equivalent diameter of 0.1 μm or more is $8.0\times10^3$ pieces/mm$^2$ or lower.

The carbides in the steel member and the base steel sheet refer to granular carbides. Specifically, those having an aspect ratio of 2.5 or less are targeted. The composition of the carbide is not particularly limited. Examples of the carbides include iron-based carbides, Nb-based carbides, and Ti-based carbides.

Further, carbides having a size of smaller than 0.1 μm do not significantly affect the ductility, particularly the local elongation. Therefore, in the present embodiment, the size of the carbides subject to the number limitation is set to 0.1 μm or larger.

The number density of the carbides is obtained by the following method.

A test piece is cut out from the position 100 mm away from the end portion of the steel member (in a case where the test piece cannot be taken from the position, a soaking portion avoiding the end) and from a ¼ position of the sheet width of the base steel sheet. After mirror-finishing the observed section of the test piece, the test piece was corroded using Picral solution, magnified 10,000 times with a scanning electron microscope, and randomly 10 visual fields (one visual field is 10 μm)×8 μm) are observed at the ¼ position of the sheet thickness. In this case, the number of a carbide having a circle equivalent diameter of 0.1 μm or more and an aspect ratio of 2.5 or less is counted, and the number density with respect to the entire visual field area is calculated to obtain the number density of the carbides having a circle equivalent diameter of 0.1 μm or more and an aspect ratio of 2.5 or less.

(D) Mechanical Properties of Steel Member

The steel member according to the present embodiment can obtain high ductility due to the TRIP effect utilizing the work-induced transformation of the residual austenite. However, when the residual austenite is transformed with a low strain, it cannot be expected that the ductility is increased due to the TRIP effect. That is, in order to further increase the ductility, it is preferable to control not only the amount or size of the residual austenite, but also properties thereof.

When the value of the strain-induced transformation parameter k represented by Expression (1) below becomes large, the residual austenite transforms at a low strain. Therefore, it is preferable that the value of the strain-induced transformation parameter k is less than 18.0.

$$k=(\log f_{\gamma 0}-\log f_{\gamma}(0.02))/0.02 \quad \text{Expression (1)}$$

Here, meaning of each symbol in Expression (1) above is as follows.

$f_{\gamma 0}$: Volume fraction of residual austenite present in the steel member before true strain is applied $f_{\gamma}(0.02)$: Volume fraction of residual austenite present in the steel member after 0.02 of true strain is applied to the steel member and then unloaded "log" in Expression (1) above is a logarithm having a base of 10, that is, a common logarithm.

The volume fractions of the residual austenite present in the steel member for $f_{\gamma 0}$ and $f_{\gamma}(0.02)$ are measured by the X-ray diffraction method described above.

It is considered that the amount of solute C in the residual austenite governs whether or not the residual austenite is likely to transform when the strain is applied, and in the range of the Mn content in the steel member according to the present embodiment, there is a positive correlation between the volume fraction of the residual austenite and the amount of solute C in the residual austenite. Then, for example, when the amount of solute C in the residual austenite is about 0.8%, the value of k is about 15, which shows good ductility. However, when the amount of solute C in the residual austenite is about 0.2%, the value of k is about 53. Accordingly, the residual austenite is entirely transformed with a low strain and the ductility decreases, resulting in deterioration of collision safety.

The steel member according to the present embodiment preferably has a tensile strength of 1,400 MPa or more and a total elongation of 10.0% or more. Furthermore, in addition to these properties, it is more preferable that the impact value at −80° C. is 25.0 J/cm$^2$ or more. This is because when having a high tensile strength of 1,400 MPa or more, good ductility of the total elongation of 10.0% or more, and good impact value of 25.0 J/cm$^2$ or more at −80° C., it will be possible to meet the demand for achieving both fuel efficiency and collision safety.

In order to achieve the good ductility and improve the collision safety, it is effective to increase the total elongation. The total elongation is an elongation obtained by adding a uniform elongation until necking occurs (uniform elongation) and a subsequent local elongation until breakage when subjecting to a tensile test. In the present embodiment, from the viewpoint of further improving the collision safety, it is preferable to increase not only the uniform elongation but also the local elongation. From the viewpoint of further improving the collision safety, the local elongation is preferably set to 3.0% or more.

In the present embodiment, the mechanical properties including the strain-induced transformation parameter k, the tensile strength, the total elongation, and the local elongation are measured using a half-size sheet-shaped test piece specified in ASTM E8-69 (ANNUAL BOOK OF ASTM STANDARD, PART10, AMERICAN SOCIETY FOR TESTING AND MATERIALS, p 120-140). Specifically, the tensile test is carried out in accordance with the regulations of the ASTM E8-69, and a room temperature tensile test is performed for a sheet-shaped test piece having a thickness of 1.2 mm, a parallel part length of 32 mm, and a parallel part sheet width of 6.25 mm at a strain rate of 3 mm/min to measure the maximum strength (tensile strength). In addition, 25 mm scribing is previously put in the parallel part in the tensile test, and broken samples are put together to measure the elongation ratio (total elongation). Then, the plastic strain at the maximum strength (uniform elongation) is subtracted from the total elongation to obtain the local elongation.

A Charpy impact test for measuring the impact value is carried out in accordance with the regulations of JIS Z 2242: 2005. The steel member is ground to obtain a thickness of 1.2 mm, a test piece having a length of 55 mm and a width of 10 mm is cut out in parallel with a rolling direction, and three test pieces are laminated to produce a test piece having a V notch. The V notch has an angle of 45°, a depth of 2 mm, and a notch bottom radius of 0.25 mm. The Charpy impact test is performed at a test temperature of −80° C. to obtain an impact value.

(E) Mn Segregation Degree of Steel Member

Mn Segregation Degree α: 1.6 or Less

In a central part of a sheet thickness cross section of the steel member (½ position of the sheet thickness), Mn is concentrated due to center segregation. When Mn is concentrated in the central part in the sheet thickness, MnS concentrates in the central part in the sheet thickness as inclusions and hard martensite is likely to be formed. Therefore, a difference in hardness from surroundings and the toughness of the steel member may deteriorate. In particular, when the value of the Mn segregation degree α represented by Expression (2) below is more than 1.6, the toughness of the steel member may deteriorate. Therefore, in order to further improve the toughness of the steel member, the value of the Mn segregation degree α of the steel member may be set to 1.6 or less. In order to further improve the toughness, the value of the Mn segregation degree α may be set to 1.2 or less. A lower limit need not be specified. The lower limit may be set to 1.0.

Mn segregation degree α=[Maximum Mn concentration (mass %) at the ½ position of the sheet thickness]/[Average Mn concentration (mass %) at the ¼ position of the sheet thickness] Expression (2)

The Mn segregation degree α is controlled mainly by the chemical composition, particularly the content of impurities and the conditions of continuous casting, and the value of the Mn segregation degree α does not significantly change by heat treatment or hot forming. Therefore, the value of the Mn segregation degree α of the steel member after the heat treatment can be set to 1.6 or less by setting the value of the Mn segregation degree α of the base steel sheet to 1.6 or less. That is, the toughness of the steel member can be further improved.

The maximum Mn concentration at the ½ position of the sheet thickness and the average Mn concentration at the ¼ position of the sheet thickness are determined by the following method.

A sample is cut out from the position 100 mm away from the end portion of the steel member (in a case where the test piece cannot be taken from the position, a soaking portion avoiding the end) and a ½ position of the sheet width of the base steel sheet, such that the observed section is parallel with a rolling direction and parallel with a sheet thickness direction. Using an electron probe microanalyzer (EPMA), line analysis (1 μm) is performed at random 10 points in the rolling direction in the ½ position of the sheet thickness of the sample. Three measurement values are selected from the analysis results in the order of high Mn concentration and an average value thereof is calculated. Accordingly, the maximum Mn concentration in the ½ position of the sheet thickness can be obtained. In addition, the average Mn concentration in the ¼ position of the sheet thickness can be obtained by using the same EPMA. The analysis is performed at 10 points in the ¼ position of the sheet thickness of the sample, and an average value thereof is calculated. Accordingly, the average Mn concentration at the ¼ position of the sheet thickness can be obtained.

(F) Cleanliness of Steel Member

Cleanliness: 0.100% or Less

When a large amount of the A-type inclusion, a B-type inclusion, and a C-type inclusion described in JIS G 0555: 2003 are present in the steel member, the toughness of the steel member may deteriorate. This is because crack propagation easily occurs when the amount of these inclusions increases. In particular, in a case of a steel member having a tensile strength of 1,400 MPa or more, it is preferable to suppress a presence proportion of these inclusions to be low. When the cleanliness value of the steel specified in JIS G 0555: 2003 is more than 0.100%, it may be difficult to secure sufficient toughness for practical use due to the large amount of inclusions. Therefore, the cleanliness value of the steel member is preferably set to 0.100% or less. In order to further improve the toughness of the steel member, the cleanliness value is more preferably set to 0.060% or less. The cleanliness value of the steel is obtained by calculating the area percentage occupied by the A-type inclusion, the B-type inclusion, and the C-type inclusions described above.

Since the cleanliness value does not significantly change due to heat treatment or hot forming, the cleanliness value of the steel member can be set to 0.100% or less by setting the cleanliness value of the base steel sheet to 0.100% or less.

In the present embodiment, the cleanliness value of the base steel sheet or the steel member is obtained by a point calculation method described in Annex 1 of JIS G 0555: 2003. For example, a sample is cut out from the ¼ position of the sheet width of the base steel sheet or from the position 100 mm away from the end portion of the steel member (in a case where the test piece cannot be taken from the position, a soaking portion avoiding the end). The ¼ position of the sheet thickness of the observed section is magnified 400 times with an optical microscope, the A type inclusion, the B type inclusion, and the C type inclusion are observed, and the area percentages thereof are calculated by the point calculation method. The observation is performed in random 10 visual fields (one visual field is 200 μm×200 μm), and the numerical value with the highest cleanliness value (lowest cleanliness) in the entire visual field is used as the cleanliness value of the base steel sheet or the steel member.

Although the steel member according to the present embodiment has been described above, a shape of the steel member is not particularly limited. The steel member may be a flat sheet, in particular, a hot-formed steel member is a formed body in many cases. In the present embodiment, a case of the formed body is also referred to as the "steel member".

Next, a method of manufacturing the steel member according to the present embodiment will be described.

The steel member according to the present embodiment can be manufactured by carrying out a heat treatment to be described later on a base steel sheet which has the above-described chemical composition, and in which a number density of a carbide having a circle equivalent diameter of 0.1 μm or more and an aspect ratio of 2.5 or less is $8.0\times10^3$ pieces/mm$^2$ or less, and an average value of circle equivalent diameters of (Nb,Ti)C is 5.0 μm or less.

The reason why a precipitation form of the carbides in the base steel sheet to be subjected to the heat treatment is limited as described above is as follows.

As described above, the precipitation of the coarse carbides in the steel member is reduced in order to suppress the decrease in ductility of the steel member. Also, in the base steel sheet before the heat treatment, it is preferable that there are few coarse carbides. Therefore, in the present embodiment, the number density of the carbides which are present in the base steel sheet and have a circle equivalent diameter of 0.1 μm or more and an aspect ratio of 2.5 or less is set to $8.0\times10^3$ pieces/mm$^2$ or less. The number density of the carbides of the base steel sheet may be measured by the same method as in the steel member, by cutting out a test piece from a ¼ portion from the end portion of the base steel sheet in a width direction.

In addition, among various carbides, when coarse (Nb, Ti)C is contained in the base steel sheet, the ductility of the steel member after the heat treatment, particularly the local elongation, is reduced, resulting in deterioration of the collision safety. The (Nb,Ti)C refers to a Nb-based carbide and a Ti-based carbide.

In particular, when the average value of circle equivalent diameters of (Nb,Ti)C present in the base steel sheet is more than 5.0 μm, the ductility of the steel member after the heat treatment deteriorates. Therefore, the average value of the circle equivalent diameters of (Nb Ti)C present in the base steel sheet is set to 5.0 μm or less.

A method of obtaining the average value of the circle equivalent diameters of (Nb,Ti)C is as follows. A cross section is cut out from a ¼ position of the sheet width of the base steel sheet, the observed section of the sample is mirror-polished, and then magnified 3,000 times with a scanning electron microscope, and random 10 visual fields (one visual field is 40 μm×30 μm) are observed. The area of each (Nb,Ti)C is calculated for all the observed (Nb,Ti)C, and a diameter of a circle having the same area as the area is set as the circle equivalent diameter of each (Nb,Ti)C. The average value of the circle equivalent diameters of the (Nb,Ti)C is obtained by calculating the average value of the circle equivalent diameters.

Next, a method of manufacturing the base steel sheet will be described.

(H) Method of Manufacturing Base Steel Sheet

A manufacturing condition of the base steel sheet, which is the steel sheet before the heat treatment of the steel member according to the present embodiment is not particularly limited. However, when using a manufacturing method to be described below, it is possible to manufacture a base steel sheet in which the precipitation form of the carbides is controlled as described above. In the following manufacturing method, for example, continuous casting, hot rolling, pickling, cold rolling, and annealing treatment are performed.

After melting the steel having the above chemical composition in a furnace, a slab is produced by casting. In this case, in order to suppress the concentrated precipitation of MnS, which is an origin of delayed fracture, it is desirable to perform a center segregation reduction treatment for reducing the center segregation of Mn. Examples of the center segregation reduction treatment include a method of discharging a molten steel in which Mn is concentrated, in the unsolidified layer before the slab is completely solidified.

Specifically, the molten steel in which Mn is concentrated before complete solidification can be discharged by performing treatments such as electromagnetic stirring and reduction of unsolidified layer.

In order to set the cleanliness of the base steel sheet to 0.100% or less, it is desirable to set the overheating temperature of the molten steel (molten steel overheating temperature) to a temperature higher than the liquidus temperature of the steel by 5° C. or higher when continuously casting the molten steel, and lower the molten steel casting amount per unit time to 6 t/min or less.

When the molten steel overheating temperature during the continuous casting is lower than the temperature which is 5° C. higher than the liquidus temperature, viscosity of the molten steel increases, and inclusions in the continuous casting machine floats up hardly. As a result, the inclusions in the slab increases and the cleanliness cannot be sufficiently reduced. Further, when the casting amount of the molten steel per unit time is more than 6 t/min, the inclusions are more likely to be trapped in the solidified shell due to rapid viscous flow of molten steel in the mold. Therefore, the inclusions in the slab increases and the cleanliness is likely to deteriorate.

On the other hand, when casting is performed by setting the molten steel overheating temperature to a temperature higher than the liquidus temperature by 5° C. or higher and setting the molten steel casting amount per unit time to 6 t/min or less, inclusions are less likely to enter the slab. As a result, the amount of the inclusions at the stage of producing the slab can be effectively reduced, and the cleanliness of the base steel sheet of 0.100% or less can be easily achieved.

When continuously casting the molten steel, it is preferable that the molten steel overheating temperature of the molten steel is set to a temperature higher than the liquidus temperature by 8° C. or higher. In addition, the molten steel casting amount per unit time is preferably set to 5 t/min or less. When setting the molten steel overheating temperature to a temperature higher than the liquidus temperature by 8° C. or higher and setting the molten steel casting amount per unit time to 5 t/min or less, the cleanliness of the base steel sheet can be set to 0.060% or less easily, which is preferable.

The slab obtained by the method described above may be subjected to a soaking treatment, as needed. When performing the soaking treatment, segregated Mn can be diffused to reduce the Mn segregation degree. When performing the soaking treatment, a preferable soaking temperature is 1,150° C. to 1,300° C., and preferable soaking time is 15 to 50 hours.

The slab obtained by the method described above is subjected to hot-rolling.

The slab is heated at 1,200° C. or higher in order to dissolve the coarse (Nb,Ti)C, and is subjected to hot rolling. In addition, from the viewpoint of more uniformly forming the carbides, it is preferable that the hot rolling start temperature is set to 1,000° C. to 1,300° C. and the hot rolling completion temperature is set to 950° C. or higher.

A coiling temperature after hot rolling is preferably high from the viewpoint of workability. However, when the coiling temperature is too high, a yield is reduced due to scale formation. Therefore, the coiling temperature is preferably set to 450° C. to 700° C. In addition, when the coiling temperature is set to a low temperature, the carbides are more likely to be finely dispersed, and coarsening of the carbides can be suppressed.

A morphology of the carbide can be controlled by adjusting a subsequent annealing conditions in addition to the conditions in the hot rolling. In this case, it is desirable that the annealing temperature is set to a high temperature to dissolve the carbide once in the annealing stage and then transform the carbide at a low temperature. Since the carbide is hard, the form thereof does not change in cold rolling, and the presence form after the hot rolling is maintained even after the cold rolling.

The base steel sheet according to the present embodiment may be a hot-rolled steel sheet or a hot-rolled annealed steel sheet, a cold-rolled steel sheet or a cold-rolled annealed steel sheet, or a surface-treated steel sheet such as a coated steel sheet. The treatment process may be appropriately selected according to the required level or the like of sheet thickness accuracy of a product. The hot-rolled steel sheet subjected to a descaling treatment is annealed as necessary to obtain a hot-rolled annealed steel sheet. The above hot-rolled steel sheet or the hot-rolled annealed steel sheet is subjected to cold rolling as needed to obtain a cold-rolled steel sheet. Further, the cold-rolled steel sheet is subjected to annealing as needed to obtain a cold-rolled annealed steel sheet. In a case where the steel sheet to be subjected to cold rolling is hard, it is preferable that annealing is performed before cold rolling to improve the workability of the steel sheet to be subjected to cold rolling.

Cold rolling may be performed using a usual method. From the viewpoint of securing good flatness, a cumulative rolling reduction in the cold rolling is preferably set to 30% or more. On the other hand, in order to avoid an excessive load, the cumulative rolling reduction in the cold rolling is preferably set to 80% or less.

In a case of manufacturing the hot rolled annealed steel sheet or the cold rolled annealed steel sheet as the base steel sheet, annealing is performed on the hot rolled steel sheet or the cold rolled steel sheet. In the annealing, for example, the hot rolled steel sheet or the cold rolled steel sheet is held in a temperature range of 550° C. to 950° C.

When setting the holding temperature in the annealing to 550° C. or higher, even in a case of manufacturing any of the hot rolled annealed steel sheet or the cold rolled annealed steel sheet, a difference in properties due to the difference in the hot rolling conditions is reduced, the properties after the hardening can be made more stable. In addition, when setting the holding temperature in the annealing of the cold rolled steel sheet to 550° C. or higher, the cold rolled steel sheet is softened due to recrystallization. Therefore, the workability can be improved. That is, a cold rolled annealed steel sheet having good workability can be obtained. Therefore, in a case of manufacturing any of the hot rolled annealed steel sheet or the cold rolled annealed steel sheet, it is preferable that the holding temperature in the annealing is 550° C. or higher.

On the other hand, when the holding temperature in the annealing is higher than 950° C., the structure may become coarse. Coarsening of the structure may reduce the toughness after hardening. In addition, even when the holding temperature in the annealing is higher than 950° C., an effect obtained by increasing the temperature is not obtained, and costs increase and productivity only decreases. Therefore, in a case of manufacturing any of the hot rolled annealed steel sheet or the cold rolled annealed steel sheet, the holding temperature in the annealing is preferably set to 950° C. or lower.

After the annealing, it is preferable to cool the steel sheet to a temperature range of 550° C. or lower at an average cooling rate of 3 to 20° C./s. When setting the average cooling rate to 3° C./s or more, generation of coarse pearlite and coarse cementite is suppressed, and the properties after hardening can be improved. In addition, when setting the average cooling rate to 20° C./s or less, occurrence of strength unevenness and the like is suppressed, and it becomes easy to stabilize a material of the hot rolled annealed steel sheet or the cold rolled annealed steel sheet.

The average cooling rate during annealing is set to a value obtained by dividing a temperature drop width of the steel sheet from the end point of annealing holding to 550° C. by time required from the end point of annealing holding to 550° C.

In a case of a coated steel sheet, the coating layer may be an electrocoating layer, a hot dip coating layer, or an alloyed hot dip coating layer. Examples of the electrocoating layer include an electrogalvanized layer and a Zn—Ni alloy electrocoating layer. Examples of the hot dip coating layer include a hot dip aluminum coating layer, a hot dip Al—Si coating layer, a hot dip Al—Si—Mg coating layer, a hot-dip galvanized layer, and a hot dip Zn—Mg coating layer. Examples of the alloyed hot dip coating layer include an alloyed hot dip aluminum coating layer, an alloyed hot dip Al—Si coating layer, an alloyed hot-dip Al—Si—Mg coating layer, an hot dip galvannealed layer, and an alloyed hot dip Zn—Mg coating layer. The coating layer may contain Mn, Cr, Cu, Mo, Ni, Sb, Sn, Ti, and the like. An adhesion amount of the coating layer is not particularly limited, and may be a general adhesion amount, for example. Similar to the base steel sheet, the steel member after the heat treatment may be provided with a coating layer or an alloy coating layer.

In the present embodiment, a steel sheet having a tensile strength of 1,400 MPa or more cannot be used as a base steel sheet. This is because when such a steel sheet is used as the base steel sheet, strength is high, and thus cracks occur during manufacturing of the steel member.

(I) Method of Manufacturing Steel Member

Next, a method of manufacturing the steel member will be described.

When subjecting the above base steel sheet to a heat treatment that goes through a temperature history as shown in FIG. 1, it is possible to obtain a steel member that has a metallographic structure including, by a volume fraction, 60.0% to 85.0% of martensite, 10.0% to 30.0% of bainite, and 5.0% to 15.0% of residual austenite, in which a length of a maximum minor axis of the residual austenite is 30 nm or longer and a number density of a carbide having a circle equivalent diameter of 0.1 μm or more and an aspect ratio of 2.5 or less is $4.0\times10^3$ pieces/mm$^2$ or less and that is good in the ductility while having high strength.

An average heating rate to be described below is set to a value obtained by dividing the temperature rising width of the steel sheet from the start of heating to the end point of heating by the time required from the start of heating to the end point of heating.

In addition, the first average cooling rate is set to a value obtained by dividing the temperature drop width of the steel sheet from the start of cooling (when taken out from the heating furnace) to the Ms point by the time required for cooling from the start of cooling to the Ms point. A second average cooling rate is set to a value obtained by dividing the temperature drop width of the steel sheet from the Ms point to the end point of cooling by the time from the Ms point to the end point of cooling. A third average cooling rate is set to a value obtained by dividing the temperature drop width of the steel sheet from the start of cooling (when taken out from the heating furnace) after the reheating process after the second cooling process to the end point of the cooling by the time required from the start of the cooling to the end point of cooling.

"Heating Process"

The above base steel sheet is heated to a temperature range of an $Ac_3$ point to ($Ac_3$ point+200)° C. at an average temperature rising rate of 5 to 300° C./s (heating process). By this heating process, the structure of the base steel sheet becomes to have an austenite single phase. When the average temperature rising rate is within the above range, even in a case where the base steel sheet at room temperature is heated, or the base steel sheet cooled to 550° C. or lower by the cooling after the annealing may be heated.

In a case where the average temperature rising rate in the heating process is lower than 5° C./s, or in a case where an achieving temperature in the heating process is higher than ($Ac_3$ point+200)° C., γ grains may be coarsened and the strength of the steel member after heat treatment may deteriorate. In addition, in the first cooling process and the second cooling process, which will be described later, austenite may not sufficiently remain, and the ductility and the toughness of the steel member may deteriorate. On the other hand, in a case where the average temperature rising rate is higher than 300° C./s in the heating process, the dissolution of the carbide does not proceed sufficiently and the hardenability deteriorates, and ferrite and pearlite precipitate in the first cooling process and the second cooling process to be described later to deteriorate the strength of the steel member. In a case where the achieving temperature is lower than the $Ac_3$ point, ferrite remains in the metallographic structure of the base steel sheet after the heating process and cannot be made into an austenite single phase, and the strength of the steel member after the heat treatment may deteriorate.

In the present embodiment, it is possible to prevent the strength, the ductility, and the toughness of the steel member from deteriorating, by carrying out the heating process satisfying the above conditions.

"First Cooling Process"

The base steel sheet that has undergone the heating process is cooled from the temperature range of the $Ac_3$ point to ($Ac_3$ point+200)° C. to the Ms point (martensitic transformation start point) at a first average cooling rate equal to or higher than the upper critical cooling rate, so as to prevent diffusion transformation from occurring, in other words, ferrite or pearlite from precipitating, (first cooling process).

The upper critical cooling rate is the minimum cooling rate at which the austenite is overcooled to form the martensite without causing the ferrite or the pearlite from precipitating in the metallographic structure. When cooling is performed at a rate lower than the upper critical cooling rate, the ferrite is generated and the strength of the steel member becomes insufficient. In addition, when cooling is performed at a rate lower than the upper critical cooling rate, the pearlite is generated and carbon is precipitated as a carbide. Therefore, the carbon cannot be concentrated in untransformed austenite in the second cooling process and the reheating process that are subsequent process, and the ductility and the toughness of the steel member are insufficient.

The $Ac_3$ point, the Ms point, and the upper critical cooling rate are measured by the following methods.

A test piece having a width of 30 mm and a length of 200 mm is cut out from the base steel sheet having the chemical composition described above. The test piece is heated to 1,000° C. in a nitrogen atmosphere at a temperature rising rate of 10° C./sec, held at the temperature for 5 minutes, and then cooled to room temperature at various cooling rates. The cooling rate is set from 1° C./sec to 100° C./sec at intervals of 10° C./sec. The $Ac_3$ point and the Ms point are measured by measuring thermal expansion change of the test piece during heating and cooling.

Further, regarding the upper critical cooling rate, the lowest cooling rate in which precipitation of the ferrite phase did not occur, among the respective test pieces cooled at the various cooling rates described above is defined as the upper critical cooling rate.

"Second Cooling Process"

After the first cooling process (cooling to the Ms point at the first average cooling rate equal to or higher than the upper critical cooling rate), cooling is performed to a temperature range of (Ms-30) to (Ms-70° C.) at a second average cooling rate that is 5° C./s or higher, and lower than 150° C./s or more and is slower than the first average cooling rate (second cooling process).

In the second cooling process of cooling to the temperature range which is equal to or lower than the Ms point, it is important to perform cooling at the second average cooling rate that is 5° C./s or higher and lower than 150° C./s and is slower than the first average cooling rate, and also important to set a cooling stop temperature to the temperature range of (Ms-30)° C. to (Ms-70)° C. By the second cooling process, residual austenite having a maximum minor axis of 30 nm or more, which greatly contributes to improvement of the ductility and the toughness of the steel member, is formed between laths of martensite, between bainitic ferrites, or at the prior γ grain boundaries. In addition, by the second cooling process, a supersaturated solid solution carbon is diffused and concentrated in the untransformed austenite from part of the generated martensite in the temperature range that is equal to or lower than the Ms point, and it is difficult to transform to plastic deformation. It is possible to generate the stable residual austenite having a k value of less than 18.

In the second cooling process, in a case where the second average cooling rate is lower than 5° C./s, carbon excessively concentrates in the untransformed austenite around the martensite formed at immediately below the Ms point, and precipitates as a carbide. As a result, carbon was not sufficiently diffused throughout the untransformed austenite, and the residual austenite cannot not be secured between laths of martensite, between the bainitic ferrites, or at the prior γ grain boundaries, and the amount thereof was not sufficient. Therefore, the ductility and the toughness of steel members are insufficient.

In a case where the second average cooling rate is 150° C./s or more, the time for carbon to diffuse into the untransformed austenite is insufficient, and martensite is generated adjacently one after another. As a result, the width of the residual austenite between the martensites becomes small (the maximum minor axis of the residual austenite becomes smaller than 30 nm), and the amount thereof is not sufficient. Therefore, the ductility and the toughness of the steel member are insufficient.

In the second cooling process, in a case where the cooling stop temperature is lower than (Ms-70)° C., a large amount of martensite is generated, and thus the amount of residual austenite becomes insufficient. Therefore, the maximum minor axis of the residual austenite becomes small and the ductility of the steel member is insufficient. The cooling stop temperature is preferably higher than 250° C., and more preferably 300° C. or higher.

In a case where the cooling stop temperature is higher than (Ms-30)° C., only a trace amount of martensite is produced. Therefore, the amount of C concentrated from martensite to untransformed austenite is insufficient. As a result, even in the subsequent reheating process, since the amount of C that is concentrated from the martensite to the untransformed austenite is insufficient, stable residual austenite cannot be secured, and the martensite is formed again in the third cooling process to be described below. Therefore, the ductility and the toughness of the steel member are insufficient.

"Reheating process" and "Third cooling process" After the second cooling process (cooling to the temperature range of (Ms-30)° C. to (Ms-70)° C. at the second average cooling rate), reheating is performed at the average temperature rising rate of 5° C./s or higher to the temperature range of Ms to (Ms+200)° C. (reheating process) and then cooling is performed at the third average cooling rate of 5° C./s or higher (third cooling process).

The reheating process promotes the diffusion and concentration of carbon into the untransformed austenite, and can increase the stability of the residual austenite. In a case where the achieving temperature in the reheating process is lower than the Ms point, carbon diffusion and concentration into the untransformed austenite are insufficient, the stability of the residual austenite is reduced, and the ductility and the toughness of the steel member are insufficient. When the achieving temperature in the reheating process is higher than (Ms+200)° C., ferrite or pearlite is generated or bainite is excessively generated. Therefore, the strength of the steel member is insufficient.

In the reheating process, in a case where the average temperature rising rate to the temperature range of Ms to (Ms+200)° C. is lower than 5° C./s, the carbon is excessively concentrated in the untransformed austenite, the bainite generation is suppressed in the temperature range of Ms to (Ms+200)° C., and the volume fraction of the bainite is reduced. Therefore, the ductility and the toughness of the steel member are insufficient.

In the third cooling process, in a case where the third average cooling rate is lower than 5° C./s, the carbon which is concentrated in the untransformed austenite may precipitate as carbides, and the stability of the residual austenite will be insufficient. Therefore, the ductility and the toughness of the steel member are insufficient.

As described above, when carrying out the heat treatment that satisfies the above conditions on the base steel sheet, it is possible to prevent the ferrite and the pearlite from being generated during cooling to the Ms point, and to retain the residual austenite during cooling at or below the Ms point between the laths of the martensite, between the bainitic ferrites, or at the prior grain boundary, in a form having a maximum minor axis of 30 nm or larger. Furthermore, after the cooling, the reheating is performed to the Ms point or higher. Accordingly, diffusion of carbon from the marten site that was previously formed into the untransformed austenite is promoted to increase the stability of residual austenite. Accordingly, it is possible to obtain a steel member good in strength and ductility.

The holding process may be performed between the heating process and the first cooling process of cooling to the Ms point. That is, after the heating process, the first cooling process may be performed after the base steel sheet is held in the temperature range of the $Ac_3$ point to ($Ac_3$ point+200)° C. for 5 to 200 seconds.

Specifically, after heating the base steel sheet to the temperature range of $Ac_3$ point to ($Ac_3$ point+200)° C., from the viewpoint of enhancing the hardenability of the steel by advancing the austenite transformation to dissolve the carbides, the base steel sheet is preferably held in the temperature range of $Ac_3$ point to ($Ac_3$ point+200)° C. for 5 s or longer. The hold time is preferably 200 s or shorter from the viewpoint of productivity.

In addition, a holding process may be performed between the reheating process and the third cooling process. That is, after the reheating process, the third cooling process may be performed after holding the base steel sheet in the temperature range of Ms to (Ms+200)° C. for 3 to 60 seconds. In the holding process, the steel sheet temperature may be changed in the temperature range of Ms to (Ms+200)° C., or the steel sheet temperature may be kept constant in the temperature range of Ms to (Ms+200)° C.

Specifically, after reheating the base steel sheet to the temperature range of Ms to (Ms+200)° C., the steel sheet is preferably held at the temperature range of Ms to (Ms+200)° C. for 3 s or longer, from the viewpoint of increasing the stability of the residual austenite by diffusing carbon. In addition, the holding time is preferably 60 s or shorter from the viewpoint of productivity.

When performing the holding process between the reheating process and the third cooling process, the residual austenite can be more stabilized, the k value can be lowered, and the TRIP effect can be further enhanced. In the holding process, it is presumed that the release of carbon from the martensite and the concentration of carbon in the residual austenite are further promoted, and the residual austenite is further stabilized. When the temperature range of the holding process is lower than the Ms point, the concentration of carbon in the residual austenite is not promoted.

The holding temperature in the holding process before the first cooling process and the holding process before the third cooling process may not be constant, and may change as long as the holding temperature is within a predetermined temperature range.

Here, in the above series of heat treatments, after heating to the temperature range of $Ac_3$ point to ($Ac_3$ point+200)° C. (after the heating process) and before cooling to the Ms point (before the first cooling process), hot forming such as hot stamp may be performed. Examples of the hot forming include bending, drawing, bulging, hole expanding, and flange forming. In addition, when means for cooling the base steel sheet is provided at the same time as or immediately after the forming, a forming method other than the press forming, for example, roll forming may be performed. When the thermal history described above is followed, repeated hot forming may be performed.

In addition, the hot forming may be performed at the same time as the first cooling process. The hot forming may be performed simultaneously with the first cooling process. That is, the first cooling process of cooling the base steel sheet at the cooling rate equal to or higher than the upper critical cooling rate is performed, and at the same time, the base steel sheet may be hot formed. In this case, since the hot forming is performed, the base steel sheet is in a soft state. Therefore, it is possible to obtain a steel member with high dimensional accuracy, which is preferable.

The above-described series of heat treatments can be carried out by any method, for example, may be carried out by induction heating and hardening, energization heating, or furnace heating.

EXAMPLES

Hereinafter, the present invention will be described more specifically using examples, but the present invention is not limited to these examples. The present invention can employ various conditions as long as the object of the present invention is achieved without departing from the gist of the present invention.

First, in manufacturing a heat-treated steel sheet member, a heat-treated steel sheet which is a base steel sheet was produced in the following manner.

"Base steel sheet" Steels having chemical compositions shown in Tables 1A and 1B were melted in a test converter and continuously cast by a continuous casting tester to produce a slab having a width of 1,000 mm and a thickness of 250 mm. In this case, in order to control the cleanliness of the base steel sheet, the overheating temperature of the molten steel and the molten steel casting amount per unit time were adjusted.

TABLE 1A

| | Steel | Chemical composition (mass %): remainder of Fe and impurities | | | | | | | | | | | | | | | | | | |
|---|---|---|---|---|---|---|---|---|---|---|---|---|---|---|---|---|---|---|---|---|
| | No. | C | Si | Mn | P | S | N | Ti | B | Cr | Ni | Cu | Mo | V | Ca | Al | Nb | Sn | W | REM |
| Invention Example | A1 | 0.20 | 2.00 | 2.01 | 0.010 | 0.0010 | 0.002 | 0.0250 | 0.0029 | 0.21 | | 0.2 | | | | | 0.046 | | | |
| | A2 | 0.52 | 1.10 | 1.20 | 0.012 | 0.0006 | 0.003 | 0.0300 | 0.0028 | 0.23 | 0.1 | 0.2 | | | | | 0.050 | | | |
| | A3 | 0.25 | 0.50 | 1.50 | 0.011 | 0.0008 | 0.004 | 0.0310 | 0.0026 | | | | 0.2 | | | | 0.050 | | | |
| | A4 | 0.25 | 2.50 | 1.20 | 0.012 | 0.0009 | 0.002 | 0.0290 | 0.0030 | 0.22 | 0.2 | | | | | | 0.048 | | | |
| | A5 | 0.44 | 1.50 | 0.38 | 0.009 | 0.0010 | 0.002 | 0.0310 | 0.0029 | 0.29 | | | | 0.2 | | | 0.050 | | | |
| | A6 | 0.44 | 1.20 | 2.50 | 0.018 | 0.0010 | 0.002 | 0.0310 | 0.0031 | | 0.1 | | | | | | 0.040 | | 0.20 | |
| | A7 | 0.30 | 0.80 | 1.30 | 0.030 | 0.0009 | 0.002 | 0.0320 | 0.0030 | 0.29 | | | | | | | 0.050 | | | 0.20 |
| | A8 | 0.32 | 0.90 | 1.30 | 0.010 | 0.0300 | 0.001 | 0.0400 | 0.0026 | 0.24 | 0.2 | | | | 0.010 | 0.04 | | | | |
| | A9 | 0.25 | 0.90 | 1.30 | 0.009 | 0.0012 | 0.008 | 0.0350 | 0.0025 | 0.15 | 0.1 | | | | | | | 0.20 | | |
| | A10 | 0.23 | 0.90 | 0.80 | 0.008 | 0.0010 | 0.001 | 0.0100 | 0.0029 | | | | 0.2 | | 0.009 | | | | | |
| | A11 | 0.22 | 1.50 | 0.80 | 0.012 | 0.0009 | 0.002 | 0.0600 | 0.0026 | 0.16 | | | | | | | 0.049 | | | |
| | A12 | 0.32 | 1.50 | 0.80 | 0.014 | 0.0009 | 0.002 | 0.0340 | 0.0010 | 0.25 | 0.1 | 0.2 | 0.2 | | | | | | | |
| | A13 | 0.33 | 2.00 | 0.60 | 0.016 | 0.0008 | 0.003 | 0.0220 | 0.0050 | 0.24 | | 0.2 | 0.2 | | | | | 0.10 | 0.10 | 0.10 |
| | A14 | 0.29 | 2.00 | 0.60 | 0.015 | 0.0009 | 0.004 | 0.0210 | 0.0027 | 0.60 | 0.4 | | | | | | | | | |
| | A15 | 0.31 | 1.50 | 0.60 | 0.008 | 0.0009 | 0.002 | 0.0300 | 0.0027 | 0.24 | 1.5 | | | 0.2 | | | | | | |
| | A16 | 0.26 | 1.50 | 0.90 | 0.009 | 0.0007 | 0.002 | 0.0290 | 0.0028 | 0.27 | | 0.6 | | 0.2 | | | 0.050 | | | |
| | A17 | 0.25 | 1.00 | 0.90 | 0.007 | 0.0008 | 0.003 | 0.0280 | 0.0029 | | | | 0.6 | | | | | | 0.10 | |
| | A18 | 0.27 | 1.00 | 0.90 | 0.009 | 0.0009 | 0.002 | 0.0250 | 0.0026 | 0.27 | | | | 0.6 | | | | | 0.20 | 0.25 |
| | A19 | 0.26 | 1.20 | 1.00 | 0.010 | 0.0009 | 0.003 | 0.0290 | 0.0028 | 0.26 | | | | | 0.005 | | | | | |
| | A20 | 0.34 | 1.20 | 1.00 | 0.011 | 0.0008 | 0.001 | 0.0280 | 0.0022 | 0.26 | 0.3 | | | 0.3 | | 0.60 | | | | |
| | A21 | 0.35 | 0.50 | 1.50 | 0.011 | 0.0010 | 0.004 | 0.0280 | 0.0024 | | | | | | | 0.60 | 0.050 | | | 0.05 |
| | A22 | 0.38 | 0.50 | 1.60 | 0.013 | 0.0010 | 0.002 | 0.0310 | 0.0025 | | | 0.5 | | | | | | 0.60 | | |
| | A23 | 0.40 | 0.60 | 1.60 | 0.012 | 0.0009 | 0.002 | 0.0230 | 0.0025 | 0.34 | | | 0.2 | | | | 0.048 | | 0.60 | |
| | A24 | 0.39 | 0.60 | 1.60 | 0.015 | 0.0009 | 0.003 | 0.0260 | 0.0026 | 0.35 | | | 0.2 | | | | | 0.10 | | 0.20 |

TABLE 1A-continued

| Steel No. | Chemical composition (mass %): remainder of Fe and impurities | | | | | | | | | | | | | | | | | | |
|---|---|---|---|---|---|---|---|---|---|---|---|---|---|---|---|---|---|---|---|
| | C | Si | Mn | P | S | N | Ti | B | Cr | Ni | Cu | Mo | V | Ca | Al | Nb | Sn | W | REM |
| A25 | 0.33 | 1.80 | 1.70 | 0.008 | 0.0100 | 0.004 | 0.0320 | 0.0031 | | | | | | | | | | | |
| A26 | 0.40 | 1.90 | 2.01 | 0.008 | 0.0010 | 0.002 | 0.0310 | 0.0019 | 0.15 | | 0.2 | | | | 0.04 | 0.050 | | 0.10 | |
| A27 | 0.45 | 0.51 | 0.39 | 0.012 | 0.0012 | 0.003 | 0.0200 | 0.0020 | 0.10 | | 0.2 | 0.1 | | | 0.58 | 0.052 | | | 0.10 |
| A28 | 0.31 | 1.00 | 1.50 | 0.006 | 0.0005 | 0.002 | 0.0250 | 0.0025 | | | | | | | | | | | |

TABLE 1B

| | Steel No. | Chemical composition (mass %): remainder of Fe and impurities | | | | | | | | | | | | | | | | | | |
|---|---|---|---|---|---|---|---|---|---|---|---|---|---|---|---|---|---|---|---|---|
| | | C | Si | Mn | P | S | N | Ti | B | Cr | Ni | Cu | Mo | V | Ca | Al | Nb | Sn | W | REM |
| Comparative Example | a1 | 0.05 | 1.20 | 1.70 | 0.012 | 0.0010 | 0.003 | 0.0210 | 0.0022 | 0.15 | | | | | | | | | | |
| | a2 | 0.80 | 1.20 | 1.70 | 0.013 | 0.0010 | 0.002 | 0.0220 | 0.0031 | | | 0.2 | | | | | 0.058 | | | |
| | a3 | 0.25 | 0.10 | 2.00 | 0.009 | 0.0009 | 0.002 | 0.0230 | 0.0022 | | 0.4 | | | | | | | | | |
| | a4 | 0.26 | 4.00 | 1.60 | 0.008 | 0.0008 | 0.002 | 0.0220 | 0.0026 | | | 0.5 | | | | | 0.051 | | | |
| | a5 | 0.31 | 0.80 | 0.10 | 0.012 | 0.0009 | 0.002 | 0.0220 | 0.0025 | | | | 0.2 | | | | | | | |
| | a6 | 0.32 | 1.10 | 6.00 | 0.011 | 0.0009 | 0.003 | 0.0240 | 0.0024 | 0.20 | | | | | | | | 0.20 | | |
| | a7 | 0.34 | 1.00 | 1.80 | 0.100 | 0.0008 | 0.001 | 0.0250 | 0.0025 | | | 0.1 | | | | | | 0.20 | | |
| | a8 | 0.34 | 1.00 | 1.80 | 0.010 | 0.1000 | 0.002 | 0.0210 | 0.0023 | | | | | | | | | | | 0.24 |
| | a9 | 0.33 | 1.50 | 1.80 | 0.010 | 0.0010 | 0.050 | 0.0210 | 0.0024 | | | | | | | | | | 0.25 | |
| | a10 | 0.33 | 1.50 | 2.00 | 0.000 | 0.0010 | 0.001 | 0.0004 | 0.0025 | | | | | 0.2 | | | 0.048 | | | |
| | a11 | 0.25 | 0.80 | 2.00 | 0.009 | 0.0009 | 0.001 | 0.5000 | 0.0026 | | | | | | 0.004 | | | | | |
| | a12 | 0.25 | 0.80 | 1.40 | 0.009 | 0.0010 | 0.001 | 0.0210 | 0.0002 | | | | | | | | 0.040 | | | |
| | a13 | 0.26 | 0.90 | 1.40 | 0.008 | 0.0009 | 0.002 | 0.0220 | 0.0500 | | | | 0.2 | | 0.005 | | 0.040 | | | |
| | a14 | 0.26 | 0.90 | 1.50 | 0.010 | 0.0011 | 0.003 | 0.0260 | 0.0024 | 1.50 | | | | | | | | | | |
| | a15 | 0.24 | 1.00 | 1.60 | 0.008 | 0.0010 | 0.002 | 0.0230 | 0.0032 | 0.80 | | | 1.5 | | | | | 0.10 | 0.10 | |
| | a16 | 0.36 | 1.30 | 1.50 | 0.010 | 0.0008 | 0.002 | 0.0310 | 0.0031 | | 0.1 | 0.2 | | | | | | 2.00 | | |

*Under lines indicates that a value is outside of the range of the present invention.

A cooling rate of the slab was controlled by changing the amount of water in a secondary cooling spray zone. In addition, the center segregation reduction treatment was performed by using a roll in a final stage of solidification, performing a light reduction with a gradient of 1 mm/m, and discharging the concentrated molten steel in the final solidification portion. Thereafter, some of the slabs were subjected to a soaking treatment under conditions of 1,250° C. and 24 h.

The obtained slab was hot rolled by a hot rolling tester to obtain a hot rolled steel sheet having a thickness of 3.0 mm. In the hot rolling process, descaling was performed after rough rolling, and finally finish rolling was performed. Then, the hot rolled steel sheet was pickled in a laboratory. Further, a cold rolled steel sheet having a thickness of 1.4 mm was obtained by carrying out cold rolling with a cold rolling tester to obtain a base steel sheet.

The number density of a carbide, the average value of the circle equivalent diameters of (Nb,Ti)C, the Mn segregation degree, and the cleanliness of the obtained base steel sheet were evaluated by the following methods.

In addition, the $Ac_3$ point, the Ms point, and the upper critical cooling rate shown in Tables 4A and 4B were obtained by the following experiments.

<Number density of a carbide>

When obtaining the number density of a carbide having a circle equivalent diameter of 0.1 μm or more, a sample is cut from the ¼ position of the sheet width of the base steel sheet and the observed section thereof was mirror-finished, and then corroded using a Picral solution, magnified 10,000 times with a scanning electron microscope. Observation was performed at random 10 visual fields (one visual field was 10 μm×8 μm) and a ¼ position of the sheet thickness. In this case, the number of a carbide having a circle equivalent diameter of 0.1 μm or more and an aspect ratio of 2.5 or less was counted, and the number density with respect to the entire visual field area was calculated to obtain the number density of the carbides having a circle equivalent diameter of 0.1 μm or more and an aspect ratio of 2.5 or less.

<Average Value of Circle Equivalent Diameters of (Nb,Ti)C>

When obtaining the average value of the circle equivalent diameters of (Nb,Ti)C, a sample was cut out from the ¼ position of the sheet width of the base steel sheet, the observed section thereof is mirror-finished, and then magnified 3,000 times with a scanning electron microscope. Then, 10 visual fields (one visual field was 40 μm×30 μm) and a ¼ position of the sheet thickness were observed. The area of all (Nb,Ti)C observed was calculated and, the diameter of the circle having the same area as this area is set as the circle equivalent diameter of each (Nb,Ti)C. The average value thereof was calculated to obtain the circle equivalent diameter of (Nb,Ti)C.

<Mn Segregation Degree>

The Mn segregation degree was measured by the following procedure. A sample was cut out from the ½ position of the sheet width of the base steel sheet such that the observed section was parallel to the rolling direction. Using an electron probe microanalyzer (EPMA), line analysis (1 μm) was performed at 10 points in the rolling direction and the sheet thickness direction in the ½ position of the sheet thickness of the steel sheet. Three measurement values were selected from the analysis results in the order of large and an average value thereof was calculated. Accordingly, the maximum Mn concentration in the thickness middle portion was obtained. In addition, in the thickness ¼ depth position from the surface of the base steel sheet (the ¼ position of the sheet thickness), similarly using the electron probe microanalyzer (EPMA), analysis was performed at 10 points. An average Mn concentration was obtained at the thickness ¼ depth portion from the surface. Then, the maximum Mn concentration at the thickness middle portion was divided by the average Mn concentration at the thickness ¼ position from the surface to determine the Mn segregation degree α (Maximum Mn concentration (mass %) at the ½ position of the sheet thickness]/[Average Mn concentration (mass %) at the ¼ position of the sheet thickness].

<Cleanliness>

For the cleanliness, a sample was cut out from the ¼ position of the sheet width of the base steel sheet, the ¼ position of the sheet thickness was magnified 400 times with an optical microscope and 10 visual fields (one visual field was 200 μm×200 μm) were observed. Then, using a point calculation method described in Annex 1 of JIS G 0555: 2003, the area percentage of the A-type inclusion, the B-type inclusion, and the C-type inclusion was calculated by the point calculation method. A numerical value indicating highest value of the cleanliness (lowest cleanliness) in multiple visual fields was taken as the cleanliness value of the base steel sheet.

<$Ac_3$ Point, Ms Point, and Upper Critical Cooling Rate>

The $Ac_3$ point and the upper critical cooling rate of each kind of steel were measured by the following method.

A strip test piece having a width of 30 mm and a length of 200 mm was cut out from the obtained base steel sheet, and the test piece was heated to 1,000° C. at a temperature rising rate of 10° C./sec in a nitrogen atmosphere, and held at the temperature for 5 minutes. Thereafter, the test piece was cooled to room temperature at various cooling rates. The cooling rate was set from 1° C./sec to 100° C./sec at intervals of 10° C./sec. In this case, the $Ac_3$ point and the Ms point were measured by measuring thermal expansion change of the test piece during heating and cooling.

Regarding the upper critical cooling rate, the lowest cooling rate in which precipitation of the ferrite phase did not occur, among the respective test pieces cooled at the cooling rates described above was defined as the upper critical cooling rate.

As described above, the average value of the circle equivalent diameters of (Nb,Ti)C, the Mn segregation degree, and the cleanliness value are not significantly changed by the heat treatment or the hot forming treatment to be performed later. Therefore, the average value of the circle equivalent diameters of (Nb,Ti)C, the Mn segregation degree α, and the cleanliness value of the base steel sheet are used as the average value of the circle equivalent diameters of (Nb,Ti)C of the steel member, the Mn segregation degree α, and the cleanliness value.

Next, using the obtained base steel sheet, heat treatment shown in the following [Example 1] to [Example 3] was performed to manufacture a steel member.

Example 1

A sample having a thickness of 1.4 mm, a width of 30 mm, and a length of 200 mm was taken from each base steel sheet described above. The sample was taken so that the longitudinal direction of the sample was parallel to the rolling direction.

Next, the taken sample was heated to a temperature range of ($Ac_3$ point+50)° C. at an average heating rate of 10° C./s and held for 120 seconds, and then cooled to the Ms point at a first average cooling rate equal to or higher than the upper critical cooling rate. Then, the sample was cooled to (Ms-50)° C. at an average cooling rate (10° C./s) slower than the first average cooling rate, then heated to (Ms+75)° C. at an average heating rate of 10° C./s, then, a heat treatment for cooling at an average cooling rate of 8° C./s was performed to obtain a steel member.

After that, the test piece was cut out from the soaking portion of the obtained steel member, and a tensile test, a Charpy impact test, an X-ray diffraction, an optical microscope observation, and a transmission electron microscope observation were performed by the following methods to evaluate the mechanical properties and the metallographic structure. The evaluation results are shown in Tables 2A and 2B.

<Tensile Test>

The tensile test was carried out by a tensile tester manufactured by Instron Co., Ltd. in accordance with the regulations of ASTM standard E8-69. A sample of the above steel member was ground to a thickness of 1.2 mm, and then a half size sheet-shaped test piece (parallel part length: 32 mm, parallel part plate width: 6.25 mm) specified in ASTM standard E8-69 was taken. In the cooling device of the electric heating device used in the heat treatment of the present example, the soaking portion obtained from the sample having a length of about 200 mm was limited, and thus a half-size sheet-shaped test piece of ASTM standard E8-69 was adopted.

Then, a strain gauge (KFGS-5 manufactured by Kyowa Denki Co., Ltd., gauge length: 5 mm) was attached to each test piece, and a room temperature tensile test was performed at a strain rate of 3 mm/min to measure the maximum strength (tensile strength). In addition, 25 mm scribing was previously put in the parallel part in the tensile test, and broken samples are put together to measure the elongation ratio (total elongation). Then, the plastic strain at the maximum strength (uniform elongation) was subtracted from the total elongation to obtain the local elongation.

In the present example, in a case where the tensile strength was 1,400 MPa or more, the strength was determined to be good which was a pass, and in a case where the tensile strength was less than 1,400 MPa, the strength was determined poor which was fail.

In addition, in a case where the total elongation was 10.0% or more, the ductility was determined good which was a pass, and in a case where the total elongation was less than 10.0%, the ductility was determined to be poor which was a fail.

Further, in a case where the product of the tensile strength and the total elongation (tensile strength TS×total elongation EL) was calculated and TS×EL was 14,000 MPa·% or more, it was determined that the strength-ductility balance was good, and in a case where the TS×EL was less than 14,000 MPa·%, it was determined that the strength-ductility balance was poor. Further, in a case where the TS×EL was 16,000 MPa·% or more, it was evaluated that the strength-ductility balance was good, and in a case where the TS×EL was 18,000 MPa·% or more, it was evaluated that the strength-ductility balance was further desirable.

<Impact Test>

The Charpy impact test was conducted in accordance with the regulations of JIS Z 2242: 2005. The steel member was ground to a thickness of 1.2 mm, a test piece having a length of 55 mm and a width of 10 mm was cut out. Three test pieces were laminated and a V-notched to produce a test piece. The V notch had an angle of 45°, a depth of 2 mm, and a notch bottom radius of 0.25 mm. The Charpy impact test was performed at a test temperature of −80° C. to obtain an impact value. In the present example, in a case where the impact value was 25.0 J/cm$^2$ or more, it was evaluated that the toughness was good.

<X-Ray Diffraction>

In the X-ray diffraction, first, a test piece was taken from the soaking portion of the steel member and chemically polished from the surface to a ¼ position of the sheet thickness, with hydrofluoric acid and hydrogen peroxide solution. The test piece after the chemical polishing was measured with a Co tube in a range of 45° to 105° at 2θ to measure the diffracted X-ray intensity of the face centered cubic lattice (residual austenite). The volume fraction of the residual austenite ($f_{\gamma 0}$) was obtained by calculating the volume fraction of the residual austenite from an area ratio of the obtained diffraction curve.

<Strain-Induced Transformation Parameter k>

An X-ray diffraction test piece was produced from a tensile test piece obtained by working a sample of the steel member into the same shape as the tensile test piece, applying constant plastic strain (true strain: ε=0.02) and unloading the strain. The volume fraction of the residual austenite ($f_\gamma(0.02)$) was determined by the same method as the above X-ray diffraction. Accordingly, the strain-induced transformation parameter k represented by the following Expression (i) was calculated and used as an index of high ductility by the TRIP effect. As k becomes larger, the residual austenite transforms with a lower strain. Therefore, constriction prevention at a high strain, that is, high ductility by the TRIP effect cannot be expected.

$$k=(\log f_{\gamma 0}-\log f_\gamma(0.02))/0.02 \quad \text{(i)}$$

Here, meaning of each symbol in the expression is as follows.

$f_{\gamma 0}$: Volume fraction of residual austenite present in the steel member before true strain is applied $f_\gamma(0.02)$: Volume fraction of residual austenite present in the steel member after 0.02 of true strain is applied to the steel member and then unloaded <Number Density of a Carbide>

A cross section was cut out from the soaking portion of the steel member, the cross section was mirror-finished, and then corroded using a Picral solution. A ¼ position of the sheet thickness was magnified 10,000 times with a scanning electron microscope and 10 visual fields (one visual field was 10 μm×8 μm) were observed. In this case, the number of a carbide having a circle equivalent diameter of 0.1 μm or more and an aspect ratio of 2.5 or less was counted, and the number (number density) with respect to the entire visual field area was calculated to obtain the number density of the carbides having a circle equivalent diameter of 0.1 μm or more and an aspect ratio of 2.5 or less.

<Maximum Minor Axis of Residual γ>

A thin film sample was taken by thin film working from the position which is the soaking portion of the steel member and at ¼ depth in the sheet thickness. Then, The thin film sample was magnified 50,000 times using the transmission electron microscope, and random 10 visual fields were observed (one visual field was 1.0 μm×0.8 μm). In this case, the residual austenite was identified using the electron beam diffraction pattern. The minor axis of the "maximum residual austenite" was measured in each visual field, three "minor axes" from the largest in 10 visual fields were selected, and the average value thereof was calculated to obtain the "maximum minor axis of residual austenite" of the steel member. Here, the "maximum residual austenite" was defined as residual austenite showing the maximum circle equivalent diameter, when the cross sectional area of the residual austenite crystal grains identified in each visual field was measured to obtain the circle equivalent diameter of a circle having the cross sectional area. In addition, the "minor axis" of the residual austenite was defined as a shortest distance (minimum Feret diameter) between parallel lines, in a case where, assuming two parallel lines sandwiching the crystal grains in contact with contours of the crystal grains with respect to the crystal grains of the residual austenite identified in each visual field, the parallel lines were drawn so as to have the shortest range between the parallel lines.

<TEM Observation>

Methods of measuring structure fractions (volume fractions) of the martensite and the bainite and detecting the presence position of the residual austenite were as follows.

Each of the volume fractions of the martensite and the bainite was measured by an electron beam diffraction apparatus attached to TEM. A measurement sample was cut out from the position which is the soaking portion of the steel member at ¼ depth in the sheet thickness to obtain a thin film sample for TEM observation. In addition, the range of TEM observation was set as a range of 400 $\mu m^2$ in area, and the magnification was set to 50,000. An iron carbide ($Fe_3C$) in the martensite and the bainite was found by a diffraction pattern of electron beam with which the thin film sample was irradiated and a precipitation form was observed to determine the martensite and the bainite. An area fraction of the martensite and an area fraction of the bainite were measured. When the precipitation form of the iron carbide was three-way precipitation, it was determined as the martensite, and when the precipitation form was one-way limited precipitation, it was determined as the bainite. The fraction of the martensite and the bainite, measured by the electron beam diffraction of the TEM was measured as an area fraction. However, since the steel member according to the present example had an isotropic metallographic structure, a value of the area fraction was directly replaced by the volume fraction. Although the iron carbide was observed to determine between the martensite and the bainite, the iron carbide was not contained in the volume fraction of the metallographic structure.

The volume fractions of the ferrite and the pearlite, which are the remainder in microstructure, were measured by the following method.

A measurement sample was cut out from the soaking portion of the steel member and used as a measurement sample for observing the remainder in microstructure. The observation range by the scanning electron microscope was 40,000 $\mu m^2$ in area, the magnification was 1,000, and the measurement position was the ¼ position of the sheet thickness. The cut measurement sample was mechanically polished and then mirror-finished. Next, etching was performed with a nital etching solution (liquid mixture of nitric acid and ethyl or methyl alcohol) to expose ferrite and pearlite, and the presence of the ferrite or the pearlite was confirmed by observing the ferrite and the pearlite with a microscope. A structure in which the ferrites and the cementites were alternately arranged in layers was determined as pearlite, and the structure in which the cementite was precipitated in a granular form was determined as the bainite. The total of the observed area fractions of the ferrite and the pearlite was obtained, and the value was directly converted into the volume fraction to obtain the volume fraction of the remainder in microstructure.

The presence position of the residual austenite was confirmed by using the electron beam diffraction pattern obtained by the TEM. Regarding the martensite of the steel member, a plurality of packets were present in the prior austenite grains. There was a block that is a parallel strip-shaped structure inside each packet. Further, There was a set of laths, which were crystals of the martensite with almost the same crystal orientation, in each block. The laths were confirmed by TEM, and the selected area diffraction pattern was measured near the boundary between the laths to confirm the electron beam diffraction pattern near the boundary between the laths. In a case where the electron beam diffraction pattern of the face centered cubic lattice was detected, it was determined that there was residual austenite between the laths.

In addition, the crystal grain structure of the bainitic ferrite was confirmed by TEM, and the selected area diffraction pattern was measured near the grain boundary of the bainitic ferrite crystal grains to confirm the electron beam diffraction pattern near the bainitic ferrite crystal grain boundary. In a case where the electron beam diffraction pattern of the face centered cubic lattice was detected, it was determined that the residual austenite was present between the bainitic ferrites.

Further, the selected area diffraction pattern was measured near the prior austenite grain boundary to confirm the electron beam diffraction pattern near the prior austenite grain boundary. In a case where the electron beam diffraction pattern of the face centered cubic lattice was detected, it was determined that there was residual austenite present between the prior austenite grain boundary.

As shown in Table 2A, Invention Examples B1 to B28 satisfying the scope of the present invention have good results in terms of metallographic structure and the mechanical properties. On the other hand, Comparative Examples b1 to b16 which do not satisfy the scope of the present invention in Table 2B resulted in not satisfying at least one of the metallographic structure and the mechanical properties.

Invention Examples B1 to B28 in Table 2A were all good, with Mn segregation degree of 1.6 or less and cleanliness of 0.100% or less. In Invention Examples B1 to B28, residual austenite was present between the laths of the martensite, between the bainitic ferrites of bainite, and at the prior austenite grain boundary.

TABLE 2A

| | No. | Steel No. | Volume fraction of residual γ (%) | Volume fraction of martensite (%) | Volume fraction of bainite (%) | Volume fraction of remainder in microstructure (%) | Maximum minor axis of retained γ (nm) | Number density of carbide (pieces/mm$^2$) |
|---|---|---|---|---|---|---|---|---|
| Invention Example | B1 | A3 | 6.6 | 65.2 | 28.2 | 0.0 | 32 | $2.9 \times 10^3$ |
| | B2 | A17 | 7.4 | 70.5 | 22.1 | 0.0 | 36 | $3.8 \times 10^3$ |
| | B3 | A6 | 7.9 | 73.0 | 19.1 | 0.0 | 36 | $3.7 \times 10^3$ |
| | B4 | A1 | 7.2 | 77.7 | 15.1 | 0.0 | 38 | $3.1 \times 10^3$ |
| | B5 | A2 | 8.3 | 70.9 | 20.8 | 0.0 | 37 | $3.2 \times 10^3$ |
| | B6 | A14 | 8.4 | 72.8 | 18.8 | 0.0 | 34 | $3.5 \times 10^3$ |
| | B7 | A15 | 8.6 | 72.2 | 19.2 | 0.0 | 36 | $2.9 \times 10^3$ |
| | B8 | A16 | 8.6 | 75.2 | 16.2 | 0.0 | 39 | $2.9 \times 10^3$ |
| | B9 | A18 | 8.0 | 72.8 | 19.2 | 0.0 | 37 | $3.2 \times 10^3$ |
| | B10 | A20 | 8.7 | 72.2 | 19.1 | 0.0 | 37 | $3.1 \times 10^3$ |
| | B11 | A21 | 7.8 | 67.0 | 25.2 | 0.0 | 33 | $3.1 \times 10^3$ |
| | B12 | A22 | 7.6 | 67.7 | 24.7 | 0.0 | 34 | $2.9 \times 10^3$ |
| | B13 | A24 | 7.6 | 68.8 | 23.6 | 0.0 | 34 | $3.3 \times 10^3$ |
| | B14 | A25 | 8.2 | 75.9 | 15.9 | 0.0 | 38 | $3.2 \times 10^3$ |
| | B15 | A26 | 9.4 | 76.7 | 13.9 | 0.0 | 42 | $3.3 \times 10^3$ |
| | B16 | A27 | 9.0 | 63.6 | 27.4 | 0.0 | 32 | $2.4 \times 10^3$ |
| | B17 | A4 | 10.5 | 71.5 | 18.0 | 0.0 | 36 | $2.4 \times 10^3$ |
| | B18 | A5 | 7.6 | 67.1 | 25.3 | 0.0 | 52 | $3.5 \times 10^3$ |
| | B19 | A7 | 7.8 | 72.1 | 20.1 | 0.0 | 38 | $2.9 \times 10^3$ |
| | B20 | A8 | 7.7 | 71.0 | 21.3 | 0.0 | 44 | $2.6 \times 10^3$ |
| | B21 | A9 | 7.8 | 72.9 | 19.3 | 0.0 | 42 | $2.2 \times 10^3$ |
| | B22 | A10 | 7.6 | 73.0 | 19.4 | 0.0 | 35 | $2.1 \times 10^3$ |
| | B23 | A11 | 8.4 | 68.9 | 22.7 | 0.0 | 45 | $2.3 \times 10^3$ |
| | B24 | A12 | 8.3 | 66.9 | 24.8 | 0.0 | 36 | $2.8 \times 10^3$ |
| | B25 | A13 | 9.0 | 67.2 | 23.8 | 0.0 | 40 | $2.7 \times 10^3$ |
| | B26 | A19 | 8.2 | 68.0 | 23.8 | 0.0 | 52 | $2.6 \times 10^3$ |
| | B27 | A23 | 7.5 | 67.6 | 24.9 | 0.0 | 35 | $3.5 \times 10^3$ |
| | B28 | A28 | 8.0 | 76.2 | 15.8 | 0.0 | 36 | $3.3 \times 10^3$ |

| | | Value of | Tensile property | | | | Impact property |
|---|---|---|---|---|---|---|---|
| | No. | strain-induced transformation parameter k | Tensile strength (MPa) | Total elongation (%) | TS × EL (MPa · %) | Local elongation (%) | Impact value (J/cm$^2$) |
| Invention Example | B1 | 16.5 | 1532 | 10.5 | 16086.0 | 3.5 | 62.9 |
| | B2 | 15.2 | 1495 | 11.0 | 16445.0 | 1.5 | 52.1 |
| | B3 | 17.1 | 2475 | 10.8 | 26730.0 | 3.5 | 27.9 |
| | B4 | 15.1 | 1435 | 11.8 | 16933.0 | 4.2 | 57.2 |
| | B5 | 13.9 | 2655 | 10.3 | 27346.5 | 1.1 | 26.2 |
| | B6 | 14.2 | 1645 | 11.0 | 18095.0 | 2.1 | 53.9 |
| | B7 | 14.1 | 1720 | 11.1 | 19092.0 | 3.2 | 59.9 |
| | B8 | 13.9 | 1546 | 11.2 | 17315.2 | 2.9 | 60.0 |
| | B9 | 14.1 | 1578 | 11.0 | 17358.0 | 2.8 | 60.2 |
| | B10 | 14.0 | 1888 | 11.3 | 21334.4 | 2.5 | 51.2 |
| | B11 | 16.0 | 1950 | 10.8 | 21060.0 | 2.6 | 49.9 |
| | B12 | 15.8 | 2110 | 10.7 | 22577.0 | 3.6 | 45.1 |

TABLE 2A-continued

| | | | | | | |
|---|---|---|---|---|---|---|
| B13 | 15.8 | 2153 | 10.8 | 23252.4 | 3.0 | 43.1 |
| B14 | 13.2 | 1948 | 11.5 | 22402.0 | 2.8 | 48.2 |
| B15 | 11.5 | 2261 | 12.1 | 27358.1 | 3.0 | 31.2 |
| B16 | 12.1 | 2301 | 16.5 | 37966.5 | 6.9 | 45.1 |
| B17 | 13.1 | 1550 | 15.1 | 23405.0 | 3.5 | 59.1 |
| B18 | 12.2 | 2261 | 12.5 | 28262.5 | 3.2 | 41.0 |
| B19 | 13.7 | 1739 | 12.4 | 21563.6 | 3.3 | 51.2 |
| B20 | 14.1 | 1825 | 13.2 | 24090.0 | 3.8 | 48.9 |
| B21 | 13.5 | 1520 | 14.9 | 22648.0 | 3.8 | 58.0 |
| B22 | 13.2 | 1479 | 14.8 | 21889.2 | 3.1 | 63.0 |
| B23 | 12.9 | 1460 | 13.1 | 19126.0 | 2.9 | 62.1 |
| B24 | 14.0 | 1790 | 12.9 | 23091.0 | 3.6 | 50.1 |
| B25 | 13.4 | 1825 | 14.5 | 26462.5 | 3.7 | 48.3 |
| B26 | 14.2 | 1540 | 13.0 | 20020.0 | 3.3 | 54.2 |
| B27 | 15.7 | 2191 | 10.9 | 23881.9 | 2.0 | 43.1 |
| B28 | 13.8 | 1857 | 12.2 | 22655.4 | 3.4 | 46.1 |

TABLE 2B

| | No. | Steel No. | Volume fraction of residual γ (%) | Volume fraction of martensite (%) | Volume fraction of bainite (%) | Volume fraction of remainder in microstructure (%) | Maximum minor axis of retained γ (nm) | Number density of carbide (pieces/mm$^2$) |
|---|---|---|---|---|---|---|---|---|
| Comparative Example | b1 | a3 | 0.4 | 66.1 | 33.5 | 0.0 | 10 | $2.7 \times 10^3$ |
| | b2 | a15 | 7.6 | 75.3 | 17.1 | 0.0 | 38 | $7.7 \times 10^3$ |
| | b3 | a6 | 10.2 | 69.0 | 20.8 | 0.0 | 21 | $3.7 \times 10^3$ |
| | b4 | a1 | 3.2 | 61.7 | 35.1 | 0.0 | 12 | $2.9 \times 10^3$ |
| | b5 | a2 | 12.1 | 72.3 | 15.6 | 0.0 | 37 | $3.8 \times 10^3$ |
| | b6 | a4 | 14.1 | 68.0 | 17.9 | 0.0 | 62 | $3.3 \times 10^3$ |
| | b7 | a5 | 2.5 | 38.9 | 58.6 | 0.0 | 20 | $1.8 \times 10^3$ |
| | b8 | a7 | 7.9 | 71.0 | 21.1 | 0.0 | 36 | $2.9 \times 10^3$ |
| | b9 | a8 | 7.7 | 68.1 | 24.2 | 0.0 | 38 | $3.3 \times 10^3$ |
| | b10 | a9 | 8.5 | 75.2 | 16.3 | 0.0 | 35 | $3.5 \times 10^3$ |
| | b11 | a10 | 8.3 | 69.1 | 22.6 | 0.0 | 37 | $3.8 \times 10^3$ |
| | b12 | a11 | 7.8 | 61.2 | 25.7 | 5.3 | 35 | $3.8 \times 10^3$ |
| | b13 | a12 | 7.6 | 71.9 | 20.5 | 0.0 | 32 | $2.9 \times 10^3$ |
| | b14 | a13 | 7.7 | 70.5 | 21.8 | 0.0 | 33 | $3.6 \times 10^3$ |
| | b15 | a14 | 8.8 | 73.9 | 17.3 | 0.0 | 35 | $6.8 \times 10^3$ |
| | b16 | a16 | 8.8 | 68.7 | 22.5 | 0.0 | 37 | $2.9 \times 10^3$ |

| | | Value of | Tensile property | | | | Impact property |
|---|---|---|---|---|---|---|---|
| | No. | strain-induced transformation parameter k | Tensile strength (MPa) | Total elongation (%) | TS × EL (MPa · %) | Local elongation (%) | Impact value (J/cm$^2$) |
| Comparative Example | b1 | 30.2 | 1588 | 9.2 | 14609.6 | 2.9 | 65.9 |
| | b2 | 16.9 | 1555 | 8.7 | 13528.5 | 0.2 | 28.5 |
| | b3 | 45.2 | 2320 | 7.6 | 17632.0 | 0.5 | 18.9 |
| | b4 | 65.3 | 732 | 13.1 | 9589.2 | 4.5 | 95.7 |
| | b5 | 12.1 | 2780 | 9.1 | 25298.0 | 0.2 | 11.2 |
| | b6 | 8.9 | 1668 | 8.9 | 14845.2 | 0.1 | 25.2 |
| | b7 | 55.1 | 1025 | 9.5 | 9737.5 | 3.2 | 75.1 |
| | b8 | 14.2 | 1965 | 9.8 | 19257.0 | 0.2 | 9.9 |
| | b9 | 13.9 | 1978 | 9.6 | 18988.8 | 0.0 | 11.2 |
| | b10 | 14.2 | 1940 | 9.6 | 18624.0 | 0.1 | 9.6 |
| | b11 | 12.9 | 1955 | 9.8 | 19159.0 | 0.2 | 12.5 |
| | b12 | 17.8 | 1250 | 15.3 | 19125.0 | 0.4 | 28.8 |
| | b13 | 15.8 | 1536 | 9.5 | 14592.0 | 0.1 | 10.0 |
| | b14 | 16.8 | 1583 | 9.8 | 15513.4 | 0.1 | 11.5 |
| | b15 | 15.1 | 1592 | 9.2 | 14646.4 | 0.1 | 29.0 |
| | b16 | 12.1 | 2030 | 9.5 | 19285.0 | 0.1 | 13.1 |

*Underlines indicate that a value is outside of the range of the present invention of that a value of property is not preferred.

Example 2

Among the kind of steel shown in Table 1A, when casting the slab having a chemical composition of Steel No. A26 and A27, the overheating temperature, the casting rate (casting amount), and the slab cooling rate were changed to change the Mn segregation degree and cleanliness of the slab. Thereafter, the slab was hot-rolled, pickled, and cold-rolled in the same manner as above, and then heat-treated under the same conditions as in Example 1 to manufacture a steel member.

Table 3 shows evaluation results of the obtained steel members C1 to C10. The evaluation method of each characteristic was performed in the same manner as in Example 1.

Invention Examples C1, C3, and C5 having good Mn segregation degree of 1.6 or less and cleanliness of 0.100% or less were even better in the impact value and the local elongation than those in Invention Examples C2 and C4 manufactured from the same steel. Invention Examples C6, C8, and C10 having good Mn segregation degree of 1.6 or less and cleanliness of 0.100% or less were even better in the impact value and the local elongation than those in Invention Examples C7 and C9 manufactured from the same steel.

On the other hand, Invention Example C2 having a slightly higher Mn segregation degree has slightly lower impact value and the local elongation than Invention Examples C1, C3, and C5 manufactured from the same steel. Invention Example C7 having a slightly higher Mn segregation degree has slightly lower impact value and the local elongation as than those in Invention Examples C6, C8, and C10 manufactured from the same steel. Invention Example C4 having a slightly higher degree of cleanliness, has a slightly lower impact value and local elongation, than those of Invention Examples C1, C3, and C5 manufactured from the same steel. Invention Example C9 having a slightly higher degree of cleanliness, has a slightly lower impact value and local elongation, than those of C6, C8, and C10 manufactured from the same steel.

In Invention Examples C1 to C10, residual austenite was present between the laths of the martensite, between the bainitic ferrites of bainite, and at the prior austenite grain boundary.

Example 3

Among the kind of steel shown in Table 1A, base steel sheets having the chemical compositions of Steel No. A26 and A27 were subjected to the heat treatment shown in Tables 4A and 4B to manufacture the steel member.

Tables 5A and 5B show evaluation results of the metallographic structure and mechanical properties of the obtained steel members.

As can be seen from Tables 4A to 5B, Invention Examples D1 to D28 satisfying the scope of the present invention have good results in the metallographic structures and the mechanical properties. Comparative Examples dl to d34, which do not satisfy the scope of the present invention, do not statisfy at least one of the metallographic structure and the mechanical properties.

Invention Examples D1 to D28 were all good, with Mn segregation degree of 1.6 or less and cleanliness of 0.100% or less. In Invention Examples D1 to D28, the residual austenite was present between the laths of the martensite, between the bainitic ferrites of bainite, and at the prior austenite grain boundary.

TABLE 3

| | No. | Steel No. | Volume fraction of residual γ (%) | Volume fraction of martensite (%) | Volume fraction of bainite (%) | Volume fraction of remainder in microstructure (%) | Maximum minor axis of retained γ (nm) | Number density of carbide (pieces/mm$^2$) | Value of strain-induced transformation parameter k |
|---|---|---|---|---|---|---|---|---|---|
| Invention Example | C1 | A26 | 9.3 | 76.8 | 13.9 | 0.0 | 42 | $3.3 \times 10^3$ | 12.1 |
| | C2 | A26 | 9.3 | 76.8 | 13.9 | 0.0 | 42 | $3.5 \times 10^3$ | 12.2 |
| | C3 | A26 | 9.4 | 76.8 | 13.8 | 0.0 | 42 | $3.5 \times 10^3$ | 12.2 |
| | C4 | A26 | 9.4 | 76.8 | 13.8 | 0.0 | 42 | $3.3 \times 10^3$ | 12.0 |
| | C5 | A26 | 9.4 | 76.8 | 13.8 | 0.0 | 41 | $3.3 \times 10^3$ | 12.0 |
| | C6 | A27 | 9.1 | 63.6 | 27.3 | 0.0 | 42 | $2.4 \times 10^3$ | 11.6 |
| | C7 | A27 | 9.1 | 63.7 | 27.2 | 0.0 | 42 | $2.5 \times 10^3$ | 11.4 |
| | C8 | A27 | 9.2 | 63.5 | 27.3 | 0.0 | 42 | $2.5 \times 10^3$ | 11.4 |
| | C9 | A27 | 9.2 | 63.7 | 27.1 | 0.0 | 43 | $2.4 \times 10^3$ | 11.5 |
| | C10 | A27 | 9.1 | 63.6 | 27.3 | 0.0 | 42 | $2.4 \times 10^3$ | 11.6 |

| | | Tensile property | | | | Impact properly | Steel member | |
|---|---|---|---|---|---|---|---|---|
| | No. | Tensile strength (MPa) | Total elongation (%) | TS × EL (MPa · %) | Local elongation (%) | Impact value (J/cm$^2$) | Mn segregation degree (—) | cleanliness (%) |
| Invention Example | C1 | 2189 | 11.8 | 25830.2 | 2.5 | 29.5 | 1.4 | 0.025 |
| | C2 | 2202 | 10.5 | 23121.0 | 0.7 | 25.6 | 3.9 | 0.026 |
| | C3 | 2206 | 11.5 | 25369.0 | 2.4 | 30.2 | 0.5 | 0.085 |
| | C4 | 2204 | 10.4 | 22921.6 | 0.8 | 26.8 | 0.4 | 0.290 |
| | C5 | 2260 | 12.1 | 27346.0 | 3.0 | 35.1 | 0.5 | 0.020 |
| | C6 | 2310 | 15.8 | 36498.0 | 5.3 | 45.2 | 1.2 | 0.028 |
| | C7 | 2310 | 13.8 | 31878.0 | 3.4 | 39.8 | 3.7 | 0.028 |
| | C8 | 2315 | 15.6 | 36114.0 | 5.1 | 44.8 | 0.4 | 0.078 |
| | C9 | 2315 | 13.8 | 31947.0 | 3.2 | 39.6 | 0.5 | 0.280 |
| | C10 | 2311 | 16.9 | 39009.7 | 6.8 | 48.1 | 0.3 | 0.030 |

TABLE 4A

| | | | Base steel sheet | | | | | Heat treatment | | | |
|---|---|---|---|---|---|---|---|---|---|---|---|
| | | | | | | | | Heating step | | Holding step | |
| | No. | Steel No. | Number density of carbide (pieces/mm$^2$) | Average value of (Nb, Ti)C (μm) | deformation point $Ac_3$ (° C.) | deformation point Ms (° C.) | Upper critical cooling rate (° C./sec) | Average temperature rising rate (° C./sec) | Attainment temperature (° C.) | Holding temperature (° C.) | Hold time (sec) |
| Invention Example | D1 | A26 | $4.3 \times 10^3$ | 3.2 | 871 | 301 | 5 | 10 | 900 | 900 | 150 |
| | D2 | A26 | $7.5 \times 10^3$ | 3.2 | 871 | 301 | 5 | 10 | 900 | 900 | 120 |
| | D3 | A26 | $6.8 \times 10^3$ | 4.2 | 871 | 301 | 5 | 10 | 910 | 910 | 120 |
| | D4 | A26 | $4.4 \times 10^3$ | 3.3 | 871 | 301 | 5 | 7 | 910 | 910 | 120 |
| | D5 | A26 | $4.5 \times 10^3$ | 2.8 | 871 | 301 | 5 | 280 | 910 | 910 | 120 |
| | D6 | A26 | $4.2 \times 10^3$ | 2.8 | 871 | 301 | 5 | 10 | 885 | 885 | 120 |
| | D7 | A26 | $4.2 \times 10^3$ | 3.4 | 871 | 301 | 5 | 10 | 1070 | 1070 | 120 |
| | D8 | A26 | $4.5 \times 10^3$ | 2.8 | 871 | 301 | 5 | 15 | 900 | 900 | 150 |
| | D9 | A26 | $4.5 \times 10^3$ | 2.5 | 871 | 301 | 5 | 15 | 900 | 900 | 150 |
| | D10 | A26 | $4.3 \times 10^3$ | 2.5 | 871 | 301 | 5 | 20 | 910 | 910 | 120 |
| | D11 | A26 | $4.3 \times 10^3$ | 2.4 | 871 | 301 | 5 | 20 | 910 | 910 | 120 |
| | D12 | A26 | $4.5 \times 10^3$ | 2.4 | 871 | 301 | 5 | 15 | 900 | 900 | 120 |
| | D13 | A26 | $4.4 \times 10^3$ | 2.9 | 871 | 301 | 5 | 15 | 900 | 900 | 150 |
| | D14 | A26 | $4.5 \times 10^3$ | 2.1 | 871 | 301 | 5 | 10 | 920 | 920 | 150 |
| | D15 | A27 | $3.9 \times 10^3$ | 1.6 | 880 | 356 | 15 | 10 | 900 | 900 | 150 |
| | D16 | A27 | $7.2 \times 10^3$ | 1.8 | 880 | 356 | 15 | 10 | 900 | 900 | 120 |
| | D17 | A27 | $6.6 \times 10^3$ | 4.0 | 880 | 356 | 15 | 10 | 910 | 910 | 120 |
| | D18 | A27 | $3.9 \times 10^3$ | 1.6 | 880 | 356 | 15 | 7 | 910 | 910 | 120 |
| | D19 | A27 | $3.8 \times 10^3$ | 1.7 | 880 | 356 | 15 | 280 | 910 | 910 | 120 |
| | D20 | A27 | $4.0 \times 10^3$ | 1.8 | 880 | 356 | 15 | 10 | 885 | 885 | 120 |
| | D21 | A27 | $4.0 \times 10^3$ | 1.8 | 880 | 356 | 15 | 10 | 1070 | 1070 | 120 |
| | D22 | A27 | $4.1 \times 10^3$ | 1.6 | 880 | 356 | 15 | 15 | 900 | 900 | 150 |
| | D23 | A27 | $3.9 \times 10^3$ | 1.8 | 880 | 356 | 15 | 15 | 900 | 900 | 150 |
| | D24 | A27 | $3.9 \times 10^3$ | 2.0 | 880 | 356 | 15 | 20 | 910 | 910 | 120 |
| | D25 | A27 | $4.0 \times 10^3$ | 2.0 | 880 | 356 | 15 | 20 | 910 | 910 | 120 |
| | D26 | A27 | $4.0 \times 10^3$ | 1.9 | 880 | 356 | 15 | 15 | 900 | 900 | 120 |
| | D27 | A27 | $3.9 \times 10^3$ | 1.7 | 880 | 356 | 15 | 15 | 900 | 900 | 150 |
| | D28 | A27 | $3.9 \times 10^3$ | 1.6 | 880 | 356 | 15 | 10 | 930 | 930 | 120 |

| | | Heat treatment | | | | | | | |
|---|---|---|---|---|---|---|---|---|---|
| | | First cooling step | Second cooling step | | Reheating step | | | | Third cooling step |
| | No. | Average cooling rate (° C./sec) | Average cooling rate (° C./sec) | Cooling stop temperature (° C.) | Average temperature rising rate (° C./sec) | Attainment temperature (° C.) | Holding temperature (° C.) | Holding time (sec) | Average cooling rate (° C./sec) |
| Invention Example | D1 | 60 | 15 | 260 | 10 | 350 | 350 | 30 | 9 |
| | D2 | 60 | 15 | 260 | 10 | 350 | 350 | 30 | 9 |
| | D3 | 80 | 20 | 260 | 15 | 350 | 350 | 30 | 9 |
| | D4 | 80 | 20 | 255 | 15 | 340 | 340 | 25 | 9 |
| | D5 | 80 | 20 | 255 | 15 | 340 | 340 | 25 | 8 |
| | D6 | 60 | 10 | 255 | 15 | 340 | 340 | 25 | 9 |
| | D7 | 60 | 10 | 260 | 15 | 340 | 340 | 25 | 9 |
| | D8 | 35 | 10 | 260 | 15 | 340 | 340 | 25 | 8 |
| | D9 | 60 | 8.5 | 260 | 10 | 350 | 350 | 25 | 10 |
| | D10 | 80 | 15 | 245 | 10 | 350 | 350 | 30 | 10 |
| | D11 | 80 | 15 | 265 | 10 | 350 | 350 | 30 | 9 |
| | D12 | 60 | 15 | 260 | 10 | 320 | 320 | 30 | 10 |
| | D13 | 60 | 15 | 260 | 10 | 450 | 450 | 30 | 9 |
| | D14 | 120 | 10 | 260 | 10 | 350 | 350 | 30 | 8 |
| | D15 | 60 | 15 | 310 | 10 | 405 | 405 | 30 | 9 |
| | D16 | 60 | 15 | 310 | 10 | 405 | 405 | 30 | 9 |
| | D17 | 80 | 20 | 310 | 15 | 405 | 405 | 30 | 9 |
| | D18 | 80 | 20 | 305 | 15 | 395 | 395 | 25 | 9 |
| | D19 | 80 | 20 | 305 | 15 | 395 | 395 | 25 | 8 |
| | D20 | 60 | 10 | 305 | 15 | 395 | 395 | 25 | 9 |
| | D21 | 60 | 10 | 310 | 15 | 395 | 395 | 25 | 9 |
| | D22 | 35 | 10 | 310 | 15 | 395 | 395 | 25 | 8 |
| | D23 | 60 | 8.5 | 310 | 10 | 405 | 405 | 25 | 10 |
| | D24 | 80 | 15 | 290 | 10 | 405 | 405 | 30 | 10 |
| | D25 | 80 | 15 | 320 | 10 | 405 | 405 | 30 | 9 |
| | D26 | 60 | 15 | 310 | 10 | 375 | 375 | 30 | 10 |
| | D27 | 60 | 15 | 310 | 10 | 505 | 505 | 30 | 9 |
| | D28 | 100 | 10 | 310 | 10 | 400 | 400 | 20 | 10 |

TABLE 4B

| | | | Base steel sheet | | | | | Heat treatment | | | |
|---|---|---|---|---|---|---|---|---|---|---|---|
| | | | | | | | Upper | Heating step | | | |
| | | | Number | Average | deformation | | critical | Average | | Holding step | |
| | | | density of | value of | point | | cooling | temperature | Attainment | Holding | Holding |
| | No. | Steel No. | carbide (pieces/mm$^2$) | (Nb, Ti)C (μm) | $Ac_3$ (° C.) | Ms (° C.) | rate (° C./sec) | rising rate (° C./sec) | temperature (° C.) | temperature (° C.) | time (sec) |
| Comparative Example | d1 | A26 | $10.5 \times 10^3$ | 3.6 | 871 | 301 | 5 | 10 | 900 | 900 | 150 |
| | d2 | A26 | $9.9 \times 10^3$ | 8.7 | 871 | 301 | 5 | 10 | 900 | 900 | 150 |
| | d3 | A26 | $4.8 \times 10^3$ | 2.8 | 871 | 301 | 5 | 1 | 950 | 950 | 90 |
| | d4 | A26 | $4.2 \times 10^3$ | 2.8 | 871 | 301 | 5 | 450 | 890 | 890 | 30 |
| | d5 | A26 | $4.2 \times 10^3$ | 3.1 | 871 | 301 | 5 | 15 | 650 | 650 | 90 |
| | d6 | A26 | $4.8 \times 10^3$ | 3.1 | 871 | 301 | 5 | 15 | 1210 | 1210 | 180 |
| | d7 | A26 | $4.5 \times 10^3$ | 3.4 | 871 | 301 | 5 | 15 | 920 | 920 | 150 |
| | d8 | A26 | $4.9 \times 10^3$ | 2.9 | 871 | 301 | 5 | 20 | 920 | 920 | 150 |
| | d9 | A26 | $5.1 \times 10^3$ | 3.2 | 871 | 301 | 5 | 20 | 920 | 920 | 150 |
| | d10 | A26 | $5.1 \times 10^3$ | 3.2 | 871 | 301 | 5 | 20 | 920 | 920 | 150 |
| | d11 | A26 | $5.1 \times 10^3$ | 3.2 | 871 | 301 | 5 | 20 | 920 | 920 | 150 |
| | d12 | A26 | $5.1 \times 10^3$ | 3.1 | 871 | 301 | 5 | 20 | 920 | 920 | 150 |
| | d13 | A26 | $5.1 \times 10^3$ | 3.1 | 871 | 301 | 5 | 20 | 920 | 920 | 150 |
| | d14 | A26 | $4.4 \times 10^3$ | 3.1 | 871 | 301 | 5 | 10 | 900 | 900 | 120 |
| | d15 | A26 | $4.8 \times 10^3$ | 3.4 | 871 | 301 | 5 | 10 | 900 | 900 | 120 |
| | d16 | A26 | $3.9 \times 10^3$ | 2.9 | 871 | 301 | 5 | 10 | 900 | 900 | 120 |
| | d17 | A26 | $5.1 \times 10^3$ | 3.2 | 871 | 301 | 5 | 10 | 900 | 900 | 150 |
| | d18 | A27 | $10.0 \times 10^3$ | 1.6 | 880 | 356 | 15 | 10 | 900 | 900 | 150 |
| | d19 | A27 | $9.4 \times 10^3$ | 8.8 | 880 | 356 | 15 | 10 | 900 | 900 | 150 |
| | d20 | A27 | $3.8 \times 10^3$ | 1.7 | 880 | 356 | 15 | 1 | 950 | 950 | 90 |
| | d21 | A27 | $4.0 \times 10^3$ | 1.8 | 880 | 356 | 15 | 450 | 890 | 890 | 30 |
| | d22 | A27 | $4.0 \times 10^3$ | 1.8 | 880 | 356 | 15 | 15 | 650 | 650 | 90 |
| | d23 | A27 | $4.1 \times 10^3$ | 1.6 | 880 | 356 | 15 | 15 | 1210 | 1210 | 180 |
| | d24 | A27 | $3.9 \times 10^3$ | 1.8 | 880 | 356 | 15 | 15 | 920 | 920 | 150 |
| | d25 | A27 | $3.9 \times 10^3$ | 2.0 | 880 | 356 | 15 | 20 | 920 | 920 | 150 |
| | d26 | A27 | $4.0 \times 10^3$ | 2.0 | 880 | 356 | 15 | 20 | 920 | 920 | 150 |
| | d27 | A27 | $4.1 \times 10^3$ | 1.6 | 880 | 356 | 15 | 20 | 920 | 920 | 150 |
| | d28 | A27 | $3.9 \times 10^3$ | 1.8 | 880 | 356 | 15 | 20 | 920 | 920 | 150 |
| | d29 | A27 | $3.9 \times 10^3$ | 2.0 | 880 | 356 | 15 | 20 | 920 | 920 | 150 |
| | d30 | A27 | $4.1 \times 10^3$ | 1.6 | 880 | 356 | 15 | 20 | 920 | 920 | 150 |
| | d31 | A27 | $4.1 \times 10^3$ | 1.6 | 880 | 356 | 15 | 10 | 900 | 900 | 120 |
| | d32 | A27 | $3.9 \times 10^3$ | 1.8 | 880 | 356 | 15 | 10 | 900 | 900 | 120 |
| | d33 | A27 | $3.9 \times 10^3$ | 2.0 | 880 | 356 | 15 | 10 | 900 | 900 | 120 |
| | d34 | A27 | $4.0 \times 10^3$ | 2.0 | 880 | 356 | 15 | 10 | 900 | 900 | 150 |

| | | Heat treatment | | | | | | | |
|---|---|---|---|---|---|---|---|---|---|
| | | First cooling step | Second cooling step | | Reheating step | | | | Third cooling step |
| | No. | Average cooling rate (° C./sec) | Average cooling rate (° C./sec) | Cooling stop temperature (° C.) | Average temperature rising rate (° C./sec) | Attainment temperature (° C.) | Holding temperature (° C.) | Holding time (sec) | Average cooling rate (° C./sec) |
| Comparative Example | d1 | 60 | 10 | 260 | 10 | 350 | 350 | 25 | 10 |
| | d2 | 50 | 15 | 260 | 10 | 350 | 350 | 25 | 9 |
| | d3 | 50 | 15 | 260 | 15 | 350 | 350 | 35 | 9 |
| | d4 | 50 | 15 | 255 | 15 | 340 | 340 | 35 | 9 |
| | d5 | 80 | 10 | 255 | 15 | 340 | 340 | 35 | 9 |
| | d6 | 80 | 10 | 255 | 15 | 340 | 340 | 35 | 9 |
| | d7 | 3 | 10 | 260 | 15 | 350 | 350 | 35 | 9 |
| | d8 | 80 | 0.3 | 260 | 10 | 350 | 350 | 35 | 9 |
| | d9 | 80 | 10 | 90 | 10 | 350 | 350 | 35 | 9 |
| | d10 | 80 | 10 | 120 | 10 | 350 | 350 | 35 | 9 |
| | d11 | 80 | 10 | 140 | 10 | 350 | 350 | 35 | 9 |
| | d12 | 80 | 10 | 176 | 10 | 350 | 350 | 35 | 9 |
| | d13 | 80 | 10 | 198 | 10 | 350 | 350 | 35 | 9 |
| | d14 | 80 | 10 | 300 | 10 | 350 | 350 | 35 | 9 |
| | d15 | 60 | 10 | 260 | 10 | 270 | 270 | 35 | 19 |
| | d16 | 60 | 10 | 260 | 10 | 580 | 580 | 35 | 19 |
| | d17 | 60 | 10 | 30 | — | — | — | — | — |
| | d18 | 60 | 10 | 310 | 10 | 400 | 400 | 25 | 10 |
| | d19 | 50 | 15 | 310 | 10 | 400 | 400 | 25 | 9 |
| | d20 | 50 | 15 | 310 | 15 | 400 | 400 | 35 | 9 |
| | d21 | 50 | 15 | 305 | 15 | 390 | 390 | 35 | 9 |
| | d22 | 80 | 10 | 305 | 15 | 390 | 390 | 35 | 9 |
| | d23 | 80 | 10 | 305 | 15 | 390 | 390 | 35 | 9 |

TABLE 4B-continued

| | | | | | | | | |
|---|---|---|---|---|---|---|---|---|
| d24 | 6 | 10 | 310 | 15 | 400 | 400 | 35 | 9 |
| d25 | 80 | 0.3 | 310 | 10 | 400 | 400 | 35 | 9 |
| d26 | 80 | 10 | 140 | 10 | 400 | 400 | 35 | 9 |
| d27 | 80 | 10 | 170 | 10 | 400 | 400 | 35 | 9 |
| d28 | 80 | 10 | 190 | 10 | 400 | 400 | 35 | 9 |
| d29 | 80 | 10 | 226 | 10 | 400 | 400 | 35 | 9 |
| d30 | 80 | 10 | 248 | 10 | 400 | 400 | 35 | 9 |
| d31 | 80 | 10 | 350 | 10 | 400 | 400 | 35 | 9 |
| d32 | 60 | 10 | 310 | 10 | 320 | 320 | 35 | 19 |
| d33 | 60 | 10 | 310 | 10 | 630 | 630 | 35 | 19 |
| d34 | 60 | 10 | 30 | — | — | — | — | — |

*Underline indicate that a value is outside of the range of the present invention.

TABLE 5A

| | | | Steel member | | | | | |
|---|---|---|---|---|---|---|---|---|
| | No. | Steel No. | Volume fraction of residual γ (%) | Volume fraction of martensite (%) | Volume fraction of bainite (%) | Volume fraction of remainder in microstructure (%) | Maximum minor axis of retained γ (nm) | Number density of carbide (pieces/mm$^2$) |
| Invention Example | D1 | A26 | 9.3 | 76.8 | 13.9 | 0.0 | 42 | $3.2 \times 10^3$ |
| | D2 | A26 | 9.0 | 77.2 | 13.8 | 0.0 | 42 | $3.8 \times 10^3$ |
| | D3 | A26 | 9.1 | 77.0 | 13.9 | 0.0 | 41 | $2.9 \times 10^3$ |
| | D4 | A26 | 9.3 | 77.2 | 13.5 | 0.0 | 39 | $2.1 \times 10^3$ |
| | D5 | A26 | 9.3 | 76.5 | 14.2 | 0.0 | 41 | $3.6 \times 10^3$ |
| | D6 | A26 | 9.2 | 76.5 | 14.3 | 0.0 | 43 | $3.8 \times 10^3$ |
| | D7 | A26 | 9.2 | 77.2 | 13.6 | 0.0 | 38 | $1.7 \times 10^3$ |
| | D8 | A26 | 9.3 | 76.9 | 13.8 | 0.0 | 42 | $3.1 \times 10^3$ |
| | D9 | A26 | 9.3 | 77.6 | 13.1 | 0.0 | 43 | $3.3 \times 10^3$ |
| | D10 | A26 | 7.0 | 80.1 | 12.9 | 0.0 | 38 | $3.1 \times 10^3$ |
| | D11 | A26 | 7.2 | 78.8 | 14.0 | 0.0 | 40 | $3.2 \times 10^3$ |
| | D12 | A26 | 7.9 | 79.3 | 12.8 | 0.0 | 43 | $3.1 \times 10^3$ |
| | D13 | A26 | 8.9 | 76.6 | 14.5 | 0.0 | 41 | $2.9 \times 10^3$ |
| | D14 | A26 | 10.4 | 75.8 | 13.8 | 0.0 | 41 | $3.3 \times 10^3$ |
| | D15 | A27 | 8.9 | 64.5 | 26.6 | 0.0 | 33 | $2.5 \times 10^3$ |
| | D16 | A27 | 8.8 | 64.6 | 26.6 | 0.0 | 32 | $3.6 \times 10^3$ |
| | D17 | A27 | 8.8 | 64.2 | 27.0 | 0.0 | 35 | $2.8 \times 10^3$ |
| | D18 | A27 | 8.2 | 66.1 | 25.7 | 0.0 | 38 | $1.8 \times 10^3$ |
| | D19 | A27 | 7.9 | 65.1 | 27.0 | 0.0 | 32 | $3.3 \times 10^3$ |
| | D20 | A27 | 7.9 | 66.1 | 26.0 | 0.0 | 32 | $3.2 \times 10^3$ |
| | D21 | A27 | 8.3 | 66.1 | 25.6 | 0.0 | 38 | $2.0 \times 10^3$ |
| | D22 | A27 | 8.9 | 64.1 | 27.0 | 0.0 | 34 | $2.5 \times 10^3$ |
| | D23 | A27 | 7.7 | 65.5 | 26.8 | 0.0 | 32 | $2.5 \times 10^3$ |
| | D24 | A27 | 6.8 | 70.2 | 23.0 | 0.0 | 33 | $2.3 \times 10^3$ |
| | D25 | A27 | 6.9 | 70.9 | 22.2 | 0.0 | 32 | $2.5 \times 10^3$ |
| | D26 | A27 | 7.8 | 70.2 | 22.0 | 0.0 | 35 | $2.7 \times 10^3$ |
| | D27 | A27 | 7.9 | 70.9 | 21.2 | 0.0 | 34 | $2.5 \times 10^3$ |
| | D28 | A27 | 9.1 | 63.5 | 27.4 | 0.0 | 33 | $2.4 \times 10^3$ |

| | | Steel member Value of | Tensile property | | | | Impact property |
|---|---|---|---|---|---|---|---|
| | No. | strain-induced transformation parameter k | Tensile strength (MPa) | Total elongation (%) | TS × EL (MPa · %) | Local elongation (%) | Impact value (J/cm$^2$) |
| Invention Example | D1 | 12.0 | 2272 | 12.0 | 27264.0 | 2.9 | 30.6 |
| | D2 | 12.0 | 2265 | 10.9 | 24688.5 | 1.9 | 25.1 |
| | D3 | 11.9 | 2266 | 10.8 | 24472.8 | 1.7 | 25.6 |
| | D4 | 12.1 | 2071 | 11.9 | 24644.9 | 3.1 | 27.2 |
| | D5 | 12.1 | 2301 | 12.2 | 28072.2 | 3.1 | 26.9 |
| | D6 | 12.0 | 2312 | 12.2 | 28206.4 | 3.0 | 25.2 |
| | D7 | 13.5 | 2089 | 11.8 | 24650.2 | 3.0 | 36.1 |
| | D8 | 12.0 | 2251 | 11.9 | 26786.9 | 2.8 | 30.9 |
| | D9 | 12.0 | 2244 | 12.0 | 26928.0 | 3.1 | 30.8 |
| | D10 | 15.1 | 2291 | 10.5 | 24055.5 | 3.0 | 29.9 |
| | D11 | 14.9 | 2272 | 10.6 | 24083.2 | 3.2 | 30.0 |
| | D12 | 15.4 | 2295 | 10.9 | 25015.5 | 3.3 | 29.8 |
| | D13 | 11.9 | 1921 | 11.2 | 21515.2 | 4.3 | 41.2 |
| | D14 | 12.2 | 2271 | 12.1 | 27479.1 | 3.0 | 30.5 |
| | D15 | 11.8 | 2296 | 16.7 | 38343.2 | 6.3 | 46.0 |
| | D16 | 11.9 | 2295 | 15.6 | 35802.0 | 5.1 | 41.0 |
| | D17 | 11.8 | 2230 | 15.7 | 35011.0 | 5.2 | 41.2 |
| | D18 | 12.0 | 2050 | 16.5 | 33825.0 | 6.0 | 45.2 |

TABLE 5A-continued

| | | | | | | |
|---|---|---|---|---|---|---|
| D19 | 11.9 | 2232 | 15.8 | 35265.6 | 5.5 | 42.1 |
| D20 | 12.0 | 2296 | 15.8 | 36276.8 | 5.6 | 41.9 |
| D21 | 12.4 | 2064 | 16.3 | 33643.2 | 6.0 | 44.8 |
| D22 | 11.8 | 2295 | 16.8 | 38556.0 | 6.3 | 46.2 |
| D23 | 14.8 | 2305 | 15.5 | 35727.5 | 6.3 | 44.6 |
| D24 | 15.1 | 2296 | 14.8 | 33980.8 | 6.3 | 42.5 |
| D25 | 15.5 | 2296 | 14.5 | 33292.0 | 6.0 | 42.8 |
| D26 | 15.3 | 2288 | 14.6 | 33404.8 | 6.3 | 42.4 |
| D27 | 15.2 | 2286 | 14.4 | 32918.4 | 6.4 | 42.7 |
| D28 | 11.6 | 2298 | 16.9 | 38790.2 | 6.5 | 46.9 |

TABLE 5B

| | | | Steel member | | | | | |
|---|---|---|---|---|---|---|---|---|
| | No. | Steel No. | Volume fraction of residual γ (%) | Volume fraction of martensite (%) | Volume fraction of bainite (%) | Volume fraction of remainder in microstructure (%) | Maximum minor axis of retained γ (nm) | Number density of carbide (pieces/mm$^2$) |
| Comparative Example | d1 | A26 | 9.3 | 76.8 | 13.9 | 0.0 | 42 | $7.5 \times 10^3$ |
| | d2 | A26 | 9.1 | 77.2 | 13.7 | 0.0 | 43 | $6.8 \times 10^3$ |
| | d3 | A26 | 4.4 | 82.7 | 12.9 | 0.0 | 41 | $2.2 \times 10^3$ |
| | d4 | A26 | 0.0 | 10.0 | 0.0 | 90.0 | — | $4.9 \times 10^3$ |
| | d5 | A26 | 0.0 | 0.0 | 0.0 | 100.0 | — | $5.2 \times 10^3$ |
| | d6 | A26 | 4.8 | 83.7 | 11.5 | 0.0 | 55 | $1.3 \times 10^3$ |
| | d7 | A26 | 0.0 | 0.0 | 10.5 | 89.5 | — | $1.9 \times 10^3$ |
| | d8 | A26 | 3.5 | 82.0 | 14.5 | 0.0 | 39 | $3.2 \times 10^3$ |
| | d9 | A26 | 0.6 | 99.4 | 0.0 | 0.0 | 4 | $2.9 \times 10^3$ |
| | d10 | A26 | 0.5 | 99.5 | 0.0 | 0.0 | 4 | $2.9 \times 10^3$ |
| | d11 | A26 | 0.4 | 99.6 | 0.0 | 0.0 | 4 | $2.9 \times 10^3$ |
| | d12 | A26 | 3.9 | 87.0 | 9.1 | 0.0 | 11 | $2.9 \times 10^3$ |
| | d13 | A26 | 4.6 | 88.6 | 6.8 | 0.0 | 13 | $2.9 \times 10^3$ |
| | d14 | A26 | 2.2 | 89.6 | 8.2 | 0.0 | 12 | $3.1 \times 10^3$ |
| | d15 | A26 | 2.5 | 88.0 | 9.5 | 0.0 | 15 | $3.2 \times 10^3$ |
| | d16 | A26 | 3.1 | 59.8 | 37.1 | 0.0 | 28 | $3.1 \times 10^3$ |
| | d17 | A26 | 0.5 | 99.5 | 0.0 | 0.0 | 3 | $2.9 \times 10^3$ |
| | d18 | A27 | 8.9 | 64.8 | 26.3 | 0.0 | 34 | $7.2 \times 10^3$ |
| | d19 | A27 | 8.8 | 65.2 | 26.0 | 0.0 | 33 | $6.7 \times 10^3$ |
| | d20 | A27 | 4.2 | 63.5 | 27.9 | 4.4 | 33 | $1.5 \times 10^3$ |
| | d21 | A27 | 0.0 | 12.0 | 0.0 | 88.0 | — | $4.8 \times 10^3$ |
| | d22 | A27 | 0.0 | 0.0 | 10.0 | 90.0 | — | $5.2 \times 10^3$ |
| | d23 | A27 | 4.5 | 82.0 | 11.5 | 2.0 | 52 | $1.3 \times 10^3$ |
| | d24 | A27 | 0.0 | 0.0 | 10.2 | 89.8 | — | $2.6 \times 10^3$ |
| | d25 | A27 | 3.2 | 66.8 | 24.7 | 5.3 | 40 | $2.3 \times 10^3$ |
| | d26 | A27 | 0.5 | 99.5 | 0.0 | 0.0 | 3 | $2.6 \times 10^3$ |
| | d27 | A27 | 0.4 | 99.6 | 0.0 | 0.0 | 4 | $2.6 \times 10^3$ |
| | d28 | A27 | 0.6 | 99.4 | 0.0 | 0.0 | 3 | $2.6 \times 10^3$ |
| | d29 | A27 | 3.8 | 88.0 | 8.2 | 0.0 | 10 | $2.6 \times 10^3$ |
| | d30 | A27 | 4.2 | 89.0 | 6.8 | 0.0 | 12 | $2.6 \times 10^3$ |
| | d31 | A27 | 2.0 | 89.2 | 8.8 | 0.0 | 12 | $2.6 \times 10^3$ |
| | d32 | A27 | 2.4 | 89.1 | 8.5 | 0.0 | 14 | $2.5 \times 10^3$ |
| | d33 | A27 | 3.0 | 64.5 | 32.5 | 0.0 | 27 | $2.4 \times 10^3$ |
| | d34 | A27 | 0.5 | 99.5 | 0.0 | 0.0 | 2 | $2.6 \times 10^3$ |

| | | Steel member Value of | Tensile properly | | | | Impact property |
|---|---|---|---|---|---|---|---|
| | No. | strain-induced transformation parameter k | Tensile strength (MPa) | Total elongation (%) | TS × EL (MPa · %) | Local elongation (%) | Impact value (J/cm$^2$) |
| Comparative Example | d1 | 12.5 | 2231 | 9.2 | 20525.2 | 0.3 | 18.2 |
| | d2 | 12.4 | 2254 | 8.8 | 19835.2 | 0.4 | 16.5 |
| | d3 | 39.5 | 1875 | 8.7 | 16312.5 | 0.1 | 45.9 |
| | d4 | — | 720 | 28.0 | 20160.0 | 10.0 | 75.2 |
| | d5 | — | 482 | 35.5 | 17111.0 | 15.5 | 102.1 |
| | d6 | 38.3 | 1820 | 8.6 | 15652.0 | 4.2 | 46.9 |
| | d7 | — | 452 | 36.5 | 16498.0 | 15.2 | 120.5 |
| | d8 | 30.1 | 2251 | 7.0 | 15757.0 | 2.8 | 30.2 |
| | d9 | 36.2 | 2511 | 7.0 | 17577.0 | 2.4 | 22.5 |
| | d10 | 36.1 | 2501 | 7.2 | 18007.2 | 2.6 | 22.5 |
| | d11 | 36.2 | 2501 | 6.9 | 17256.9 | 2.2 | 22.3 |
| | d12 | 37.1 | 2499 | 7.1 | 17742.9 | 2.5 | 22.2 |
| | d13 | 38.2 | 2512 | 6.9 | 17332.8 | 2.1 | 21.9 |
| | d14 | 38.0 | 2488 | 7.8 | 19406.4 | 2.6 | 22.9 |
| | d15 | 29.2 | 2382 | 8.5 | 20247.0 | 2.9 | 25.1 |

TABLE 5B-continued

| | | | | | | |
|---|---|---|---|---|---|---|
| d16 | 25.2 | 1543 | 8.2 | 12652.6 | 2.8 | 35.2 |
| d17 | 36.1 | 2532 | 6.8 | 17217.6 | 2.2 | 19.8 |
| d18 | 11.9 | 2295 | 9.8 | 22491.0 | 0.5 | 22.8 |
| d19 | 11.8 | 2293 | 9.8 | 22471.4 | 0.4 | 23.5 |
| d20 | 40.0 | 1852 | 9.7 | 17964.4 | 0.1 | 51.2 |
| d21 | — | 800 | 25.9 | 20720.0 | 12.0 | 77.0 |
| d22 | — | 455 | 36.2 | 16471.0 | 16.3 | 95.0 |
| d23 | 39.1 | 1832 | 9.7 | 17770.4 | 1.2 | 51.2 |
| d24 | — | 465 | 35.8 | 16647.0 | 15.8 | 99.0 |
| d25 | 31.5 | 2265 | 9.5 | 21517.5 | 5.7 | 41.2 |
| d26 | 36.5 | 2298 | 8.8 | 20222.4 | 4.5 | 40.9 |
| d27 | 36.6 | 2295 | 8.7 | 19966.5 | 4.6 | 41.0 |
| d28 | 36.1 | 2258 | 8.8 | 19870.4 | 4.4 | 40.8 |
| d29 | 36.5 | 2289 | 8.5 | 19456.5 | 4.3 | 41.2 |
| d30 | 37.1 | 2293 | 8.8 | 20178.4 | 4.5 | 42.0 |
| d31 | 36.8 | 2295 | 8.4 | 19278.0 | 4.6 | 41.5 |
| d32 | 30.2 | 2375 | 9.8 | 23275.0 | 6.3 | 39.0 |
| d33 | 27.1 | 1468 | 8.7 | 12771.6 | 6.1 | 63.5 |
| d34 | 36.2 | 2319 | 8.4 | 19479.6 | 4.1 | 36.2 |

*Underlines indicate that a value is outside of the range of the present invention of that a value of property is not preferred.

INDUSTRIAL APPLICABILITY

According to the above aspect of the present invention, it is possible to obtain a steel member which has a tensile strength of 1,400 MPa or more and is good in ductility. The steel member according to the present invention is particularly suitable for use as a collision-resistant component for a vehicle.

The invention claimed is:

1. A steel member comprising, as a chemical composition, by mass %:

C: 0.10% to 0.60%;
Si: 0.40% to 3.00%;
Mn: 0.30% to 3.00%;
P: 0.050% or less;
S: 0.0500% or less;
N: 0.010% or less;
Ti: 0.0010% to 0.1000%;
B: 0.0005% to 0.0100%;
Cr: 0% to 1.00%;
Ni: 0% to 2.0%;
Cu: 0% to 1.0%;
Mo: 0% to 1.0%;
V: 0% to 1.0%;
Ca: 0% to 0.010%;
Al: 0% to 1.00%;
Nb: 0% to 0.100%;
Sn: 0% to 1.00%;
W: 0% to 1.00%;
REM: 0% to 0.30%; and
a remainder of Fe and impurities, wherein a metallographic structure includes, by volume fraction, 60.0% to 85.0% of martensite, 10.0% to 30.0% of bainite, 5.0% to 15.0% of residual austenite, and 0% to 4.0% of ferrite and pearlite, wherein a total volume fraction of the martensite, the bainite, and the residual austenite is 96.0% or more, a length of a maximum minor axis of the residual austenite is 30 nm or longer, and a number density of a carbide having a circle equivalent diameter of 0.1 μm or more and an aspect ratio of 2.5 or less is $4.0\times10^3$ pieces/mm$^2$ or less.

2. The steel member according to claim 1, comprising, as the chemical composition, by mass %, at least one selected from the group consisting of:

Cr: 0.01% to 1.00%;
Ni: 0.01% to 2.0%;
Cu: 0.01% to 1.0%;
Mo: 0.01% to 1.0%;
V: 0.01% to 1.0%;
Ca: 0.001% to 0.010%;
Al: 0.01% to 1.00%;
Nb: 0.010% to 0.100%;
Sn: 0.01% to 1.00%;
W: 0.01% to 1.00%; and
REM: 0.001% to 0.30%.

3. The steel member according to claim 1, wherein a value of a strain-induced transformation parameter k represented by Expression (1) below is less than 18.0, $$k=(\log f_{\gamma 0}-\log f_{\gamma}(0.02))/0.02 \quad \text{Expression (1)}$$

here, meaning of each symbol in Expression (1) is as follows:

$f_{\gamma 0}$: volume fraction of residual austenite present in the steel member before true strain is applied; and $f_{\gamma}(0.02)$: volume fraction of residual austenite present in the steel member after 0.02 of true strain is applied to the steel member and then unloaded.

4. The steel member according to claim 1, wherein a tensile strength is 1,400 MPa or more, and a total elongation is 10.0% or higher.

5. The steel member according to claim 1, wherein a local elongation is 3.0% or higher.

6. The steel member according to claim 1, wherein an impact value at −80° C. is 25.0 J/cm$^2$ or more.

7. The steel member according to claim 1, wherein a value of cleanliness of a steel specified by JIS G 0555: 2003 is 0.100% or less.

8. A method of manufacturing a steel member according to claim 1, the method comprising:

a heating process of heating a base steel sheet to a temperature range of $Ac_3$ point to ($Ac_3$ point+200°) C. at an average heating rate of 5 to 300° C./s, the base steel sheet including, as a chemical composition, by mass %, C: 0.10% to 0.60%, Si: 0.40% to 3.00%, Mn: 0.30% to 3.00%, P: 0.050% or less, S: 0.0500% or less, N: 0.010% or less, Ti: 0.0010% to 0.1000%, B: 0.0005% to 0.0100%, Cr: 0% to 1.00%, Ni: 0% to 2.0%, Cu: 0% to 1.0%, Mo: 0% to 1.0%, V: 0% to 1.0%, Ca: 0% to 0.010%, Al: 0% to 1.00%, Nb: 0% to 0.100%, Sn: 0% to 1.00%, W: 0% to 1.00%, REM: 0% to 0.30%, and a remainder consisting of Fe and impurities, in which a number density of carbide having a circle equivalent diameter of 0.1 μm or more and an aspect ratio of 2.5 or less is $8.0\times10^3$ pieces/$mm^2$ or less, and an average value of circle equivalent diameters of (Nb, Ti)C is 5.0 μm or less;

a first cooling process of cooling the base steel sheet to a Ms point at a first average cooling rate equal to or higher than an upper critical cooling rate, after the heating process;

a second cooling process of cooling the base steel sheet to a temperature range of (Ms−30°) C. to (Ms−70°) C. at a second average cooling rate of 5° C./s or higher and lower than 150° C./s, which is slower than the first average cooling rate, after the first cooling process;

a reheating process of reheating the base steel sheet to a temperature range of Ms to (Ms+200°) C. at an average heating rate of 5° C./s or higher, after the second cooling process; and a third cooling process of cooling the base steel sheet at a third average cooling rate of 5° C./s or higher, after the reheating process.

9. The method of manufacturing a steel member according to claim 8, further comprising:

a holding process of holding the base steel sheet at the temperature range of $Ac_3$ point to ($Ac_3$ point+200°) C. for 5 to 200 seconds, between the heating process and the first cooling process.

10. The method of manufacturing a steel member according to claim 8, further comprising:

a holding process of holding the base steel sheet at the temperature range of Ms to (Ms+200°) C. for 3 to 60 seconds, between the reheating process and the third cooling process.

11. The method of manufacturing a steel member according to claim 8, further comprising:

hot forming the base steel sheet, between the heating process and the first cooling process.

12. The method of manufacturing a steel member according to claim 8, wherein in the first cooling process, the base steel sheet is cooled at the first average cooling rate and hot-formed at the same time.

* * * * *